US008328318B2

(12) United States Patent
Igarashi et al.

(10) Patent No.: US 8,328,318 B2
(45) Date of Patent: Dec. 11, 2012

(54) PRINTING METHOD AND PRINTING APPARATUS

(75) Inventors: Hitoshi Igarashi, Shiojiri (JP); Kenji Hatada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 477 days.

(21) Appl. No.: 12/550,278

(22) Filed: Aug. 28, 2009

(65) Prior Publication Data

US 2010/0053251 A1 Mar. 4, 2010

(30) Foreign Application Priority Data

Aug. 29, 2008 (JP) ..... 2008-221958

(51) Int. Cl.
*B41J 29/38* (2006.01)

(52) U.S. Cl. ..... 347/16; 347/5; 347/14

(58) Field of Classification Search ..... 347/8, 14, 347/16, 5, 9, 19; 400/614
See application file for complete search history.

(56) References Cited

U.S. PATENT DOCUMENTS

| | | | | |
|---|---|---|---|---|
| 7,159,960 | B2 * | 1/2007 | Nunokawa et al. | 347/14 |
| 2003/0007023 | A1 * | 1/2003 | Barclay et al. | 347/8 |
| 2007/0059080 | A1 * | 3/2007 | Silverbrook et al. | 400/614 |

FOREIGN PATENT DOCUMENTS

| | | | |
|---|---|---|---|
| JP | 5-16327 | U | 3/1993 |
| JP | 06-143717 | A | 5/1994 |
| JP | 06-296394 | A | 10/1994 |
| JP | 2003-048351 | A | 2/2003 |
| JP | 2003-063707 | A | 3/2003 |
| JP | 2003-079177 | A | 3/2003 |
| JP | 2006-240212 | A | 9/2006 |
| JP | 2007-290866 | A | 11/2007 |

* cited by examiner

*Primary Examiner* — Lam S Nguyen
(74) *Attorney, Agent, or Firm* — Kilpatrick Townsend & Stockton LLP

(57) ABSTRACT

There is provided a printing method using a first motor that applies a driving force for rotating a roll body around which a printing medium is wound, a second motor that applies a driving force for intermittently driving a transport driving roller that transports the printing medium, and a print head that intermittently ejects ink onto the printing medium alternately with the driving of the second motor. The printing method includes driving the first motor such that tension applied to the printing medium is constant during at least a part of a period in which the second motor is driven and stopping the driving of the first motor during at least a part of a period in which the driving of the second motor is stopped.

16 Claims, 21 Drawing Sheets

FIG. 20

PARAMETER TABLE

| SPEED MODE | VM1 | VM2 | VM3 | VM4 |
|---|---|---|---|---|
| PF MAXIMUM SPEED [ips] | 5 | 3 | 1 | 0.15 |
| UPPER LIMIT OF TRANSPORT SPEED [ips] | 5.5 | 3.3 | 1.1 | 0.165 |
| LIMIT VALUE OF TRANSPORT AMOUNT [EP] | 1 | 1 | 1 | 1 |
| FREE-RUNNING BRAKING RATE [%] | 100 | 90 | 70 | 70 |
| CONTROL TRANSFERRING TRANSPORT SPEED [ips] | 2.55 | 1.7 | 0.25 | 0.1 |
| CONTROL COMPLETING TRANSPORT SPEED [ips] | 0.2 | 0.2 | 0.2 | 0.09 |
| INITIAL TENSION [gf] | 1 | 1 | 1 | 350 |

PRINTING METHOD AND PRINTING APPARATUS

This application claims priority to Japanese Patent Application No. 2008-221958, filed Aug. 29, 2008, the entirety of which is incorporated by reference herein.

BACKGROUND

1. Technical Field

The present invention relates to a printing method and a printing apparatus.

2. Related Art

Among ink jet printers, there is a type that uses large-sized paper sheets having a size that is equal to or larger than A2. In such ink jet printers used for large-sized paper sheets, a roll paper is frequently used in addition to single printing sheets. Hereinafter, it is assumed that a roll paper is acquired by winding paper into a roll body, and pulling out a part from the roll body, which is referred to as a paper sheet. The pulling of the paper sheet from the roll body is performed by driving a transport roller to rotate using a paper transporting motor (PF motor). The PF motor is controlled using PID control. An example of a printer that uses the above-described roll body is disclosed in JP-A-2007-290866. In addition, as an example of printers that perform the PID control, there are the printers that have been disclosed in JP-A-2006-240212, JP-A-2003-79177, and JP-A-2003-48351.

Commonly, the transport roller is set to be separated from the roll body, that is installed to a printer main body, by a predetermined distance in a direction in which a paper sheet is supplied. Accordingly, there are cases where a paper sheet that is pulled out from the roll body is loosened between the roll body and the transport roller. For example, when printing has started, a user performs an operation for pulling out a paper sheet from the roll body, that is installed in the printer main body, and setting the paper sheet to a paper transporting mechanism that is configured by a PF motor, a transport roller, and the like. However, at that moment, there are cases where the paper sheet is loosened between the roll body and the paper transporting mechanism. In addition, there are cases where a paper sheet is fed back (that is, rewound to return) in order to adjust the lead of the paper sheet after the paper sheet is set in a paper transporting mechanism, and also at that moment, there are cases where the paper sheet is loosened. When a printing process is performed using the loosened paper sheet, a printed image is disturbed so that the image quality deteriorates. Thus, commonly, the user checks for such looseness. When the paper sheet is determined to be loose, for example, the user rotates the roll body so as to wind the loosened portion of the paper sheet. As described above, in a printer that uses the roll body, a user needs to eliminate the looseness of the paper sheet manually, and there is a problem that time is needed to eliminate the looseness of the paper sheet. In addition, when the looseness is missed or the looseness cannot be eliminated sufficiently, the printed image may be disturbed.

SUMMARY

Embodiments of the invention provide a printing method and a printing apparatus that are capable of appropriately eliminating looseness of a paper sheet.

According to a first aspect of the invention, there is provided a printing method using a first motor that applies a driving force for rotating a roll body around which a printing medium is wound, a second motor that applies a driving force for intermittently driving a transport driving roller that transports the printing medium, and a print head that intermittently ejects ink onto the printing medium alternately with the driving of the second motor. The printing method includes: driving the first motor such that tension applied to the printing medium is constant during at least a part of the period in which the second motor is driven; and stopping the first motor from driving for at least a part of the period in which the driving of the second motor is stopped.

According to the above-described printing method, the driving of the second motor and ink ejecting of the print head are intermittently performed in an alternating manner. Thus, although there is a period (i.e., a period in which ink ejection is performed by the print head) in which the driving of the second motor has stopped, driving of the first motor is also stopped during at least a part of that period. Accordingly, the processing load for controlling the driving of the first motor and the power consumption of the first motor can be suppressed. In addition, when the tension applied to the printing medium at a time when the printing medium is transported by the driving of the second motor is unstable, the amount of slip in the transport operation becomes unstable, and accordingly, the amount of transport becomes incorrect. However, the above-described problem of the amount of slip does not occur in the period in which the second motor is not driven, and accordingly, the driving of the first motor can be stopped. The driving according to an embodiment of the invention represents a state in which each motor actively generates a driving force and is not limited to a state in which the driving unit of each motor is actually rotated by the driving force or the like.

The tension applied to the printing medium and the amount of slip of the printing medium at the time of transport linearly correspond to each other. Thus, if the tension applied to the printing medium can be set to a desired amount, the amount of slip of the printing medium at the time of transport can be set to a desired amount. Accordingly, it is preferable that the first motor is driven such that the tension applied to the printing medium becomes a designated tension which corresponds to the desired amount of slip. In addition, the appropriate amount of slip and the tension for achieving the appropriate amount of slip are changed depending on the type of the printing medium. Accordingly, it may be configured that the designated tension is appropriately set in accordance with the type of the printing medium.

On the other hand, for a case where the tension applied to the printing medium is to be decreased so as to be the designated tension, when the tension is decreased before driving of the second motor is started, transport of the printing medium can be started by smoothly using the second motor. Accordingly, it may be configured that driving of the first motor is started from a predetermined time before the start of the driving of the second motor for a case where the tension applied to the printing medium is to be decreased so as to be the designated tension. In addition, it may be configured that a second driving force, that is larger than a first driving force, is used for setting the tension at the designated tension, and is outputted to the first motor when the tension is to be decreased in advance. In such a case, the transport of the printing medium can be assisted more assuredly by the second motor.

As an example of the timing for eliminating the above-described assist by using the first motor, it may be configured that, when a driving speed of the first motor reaches a predetermined transfer speed after the driving of the first motor is started, the driving force output to the first motor is switched from the second driving force to the first driving force. Thereafter, the driving force output to the first motor is switched to the first driving force after the driving speed reaches the predetermined transfer speed, and accordingly, the above-described tension can be achieved.

In addition, the roll body can freely run in accordance with the inertia due to the weight of the roll body, after the driving of the second motor is stopped, or the like. In such a case, as the roll body freely runs, the roll body sends out the printing medium by an amount of transport that is not intended, and accordingly there is a mismatch between the amount of transport and the driving amount of the second motor. In other words, looseness of the printing medium is generated between the roll body and the transport driving roller. In order to prevent this, it may be configured that the driving force output to the first motor is switched to a third driving force, which is acquired by decreasing the first driving force at a predetermined braking ratio, after the driving of the second motor is stopped, whereby the roll body is braked.

In addition, when the driving speed of the first motor is abnormally higher than that of the second motor, there is a mismatch in the amounts of transport, and looseness of the printing medium is generated. In order to prevent this, it is preferable that the driving force output to the first motor is set to zero when the driving speed of the first motor exceeds a predetermined upper limit of the speed. In addition, due to the same reason, it may be configured that the driving of the first motor is stopped when a transport amount of the printing medium, that is sent out by the roll body after the driving of the first motor, has started exceeds a predetermined upper limit of the transport amount. In addition, it may be configured that the driving of the first motor is stopped when the driving speed of the first motor is lower than a predetermined completion speed, except for a period of time right after the driving of the first motor is started. In such a case, the driving of the first motor can be stopped after the driving of the second motor is stopped.

In addition, the driving of the first motor is performed so as to follow the driving of the second motor. Accordingly, the movement of the first motor is largely dependent upon the driving pattern of the second motor. Thus, when one or more of the second driving force, the transfer speed, the upper limit of the speed, the upper limit of the transport amount, the braking ratio, and the completion speed are set in accordance with the speed mode corresponding to the maximum driving speed of the second motor, a condition that is appropriate for the movement of the first motor can be set.

On the other hand, when the tension is increased by driving the first motor for applying the designated tension to the above-described printing medium, the printing medium is placed in a low-tension state. Accordingly, the transport can be started smoothly by using the second motor without performing the above-described assist. Thus, the driving of the first motor is started simultaneously with start of the driving of the second motor. Accordingly, the driving time of the second motor can be shortened, and thereby the power consumption can be suppressed. In addition, for stopping the driving, the driving of the first motor is stopped simultaneously with the stopping of the driving of the second motor.

In addition, it is preferable that short brake is applied to the first motor in a period in which driving of the first motor is stopped. In such a case, even when an external force is applied to the printing medium by the user or the like, for example, in the period in which driving of the first motor is stopped, a large braking force can be applied, and accordingly, transport of the printing medium that is not intended can be prevented.

Embodiments of the invention can be implemented not only as a printing method but also as a printing apparatus that performs the printing method. In other words, the invention may be specified as a printing apparatus that has units corresponding to the processes that are performed in the processes included in the above-described printing method. In addition, it is apparent that, when the above-described printing apparatus implements the above-described units by reading out a program, embodiments of the invention can be implemented in a program that performs functions corresponding to the units or any type of the recording medium on which the program is recorded. In addition, it is apparent that the printing apparatus, according to an embodiment of the invention, may be implemented not only as a single apparatus but also as a plurality of apparatuses.

BRIEF DESCRIPTION OF THE DRAWINGS

The invention will be described with reference to the accompanying drawings, wherein like numbers reference like elements.

FIG. 20 is a diagram showing an example of a parameter table PT, according to an embodiment of the invention.

DESCRIPTION OF EXEMPLARY EMBODIMENTS

Hereinafter, embodiments of the invention will be described in the following order.

| | |
|---|---|
| 1. | Configuration of Printer |
| 2-1. | Entire Process |
| 2-2. | Measurement Process |
| 2-3. | Estimation Process |
| 2-4. | Printing Process |
| 2-5. | Roll Control Process |
| 2-6. | Looseness Eliminating Process |

1. Configuration of Printer

Hereinafter, a printer 10 as a printing apparatus (fluid ejecting apparatus) according to an embodiment of the invention and a control process thereof will be described. The printer 10 according to this embodiment, for example, is a printer for printing a large-sized paper sheet that is equal to or larger than A2 of the JIS standard. In addition, the printer according to this embodiment is an ink jet printer. The ink jet printer may employ any ejection method for ejecting ink. In addition, in the description below, the lower side denotes a side on which the printer 10 is mounted, and the upper side denotes a side that is apart from the side on which the printer 10 is mounted. In addition, a side on which a paper sheet P is supplied is described as a supply side (rear side), and a side on which a paper sheet P is discharged is described as a paper discharging side (front side).

Figure 1:
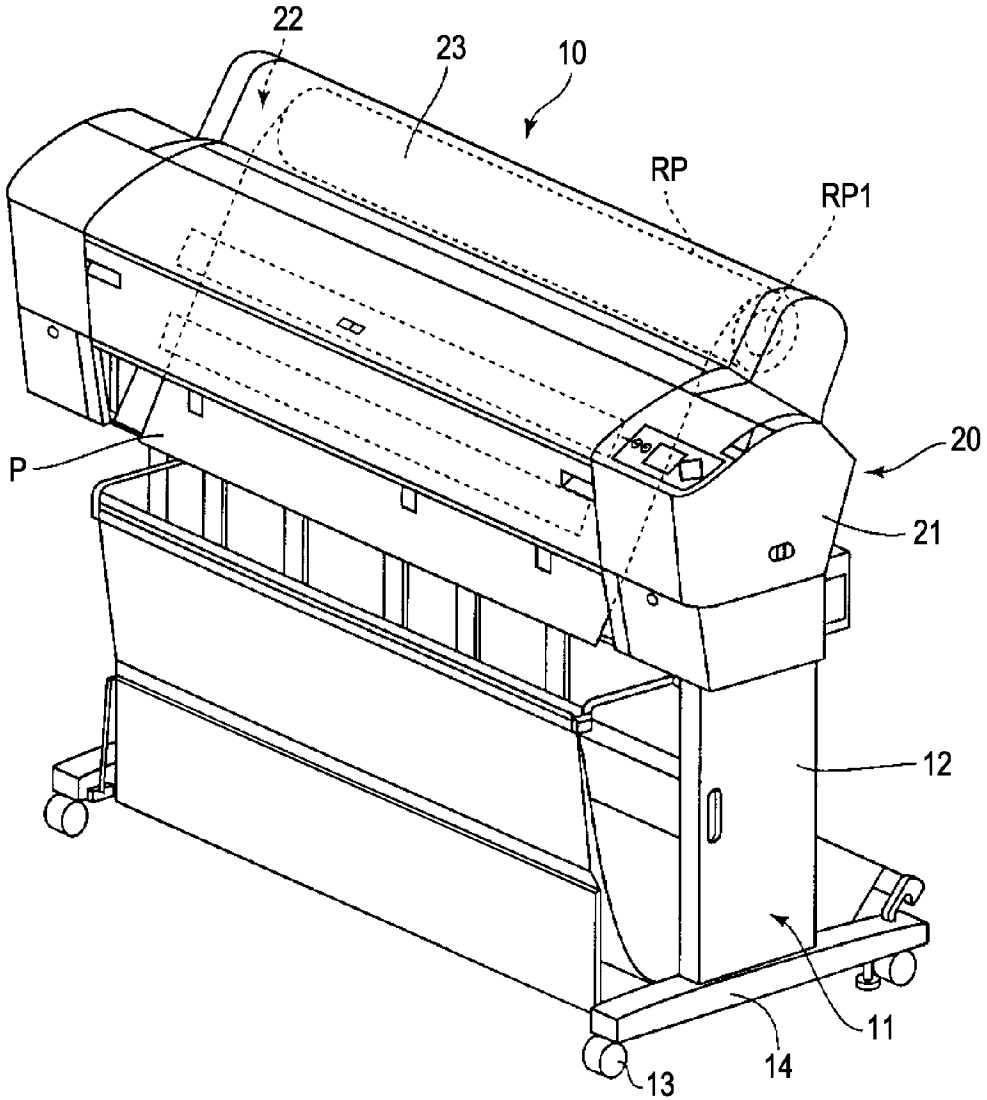
FIG. 1 is a perspective view showing the configuration of a printer, according to an embodiment of the invention.
Figure 2:
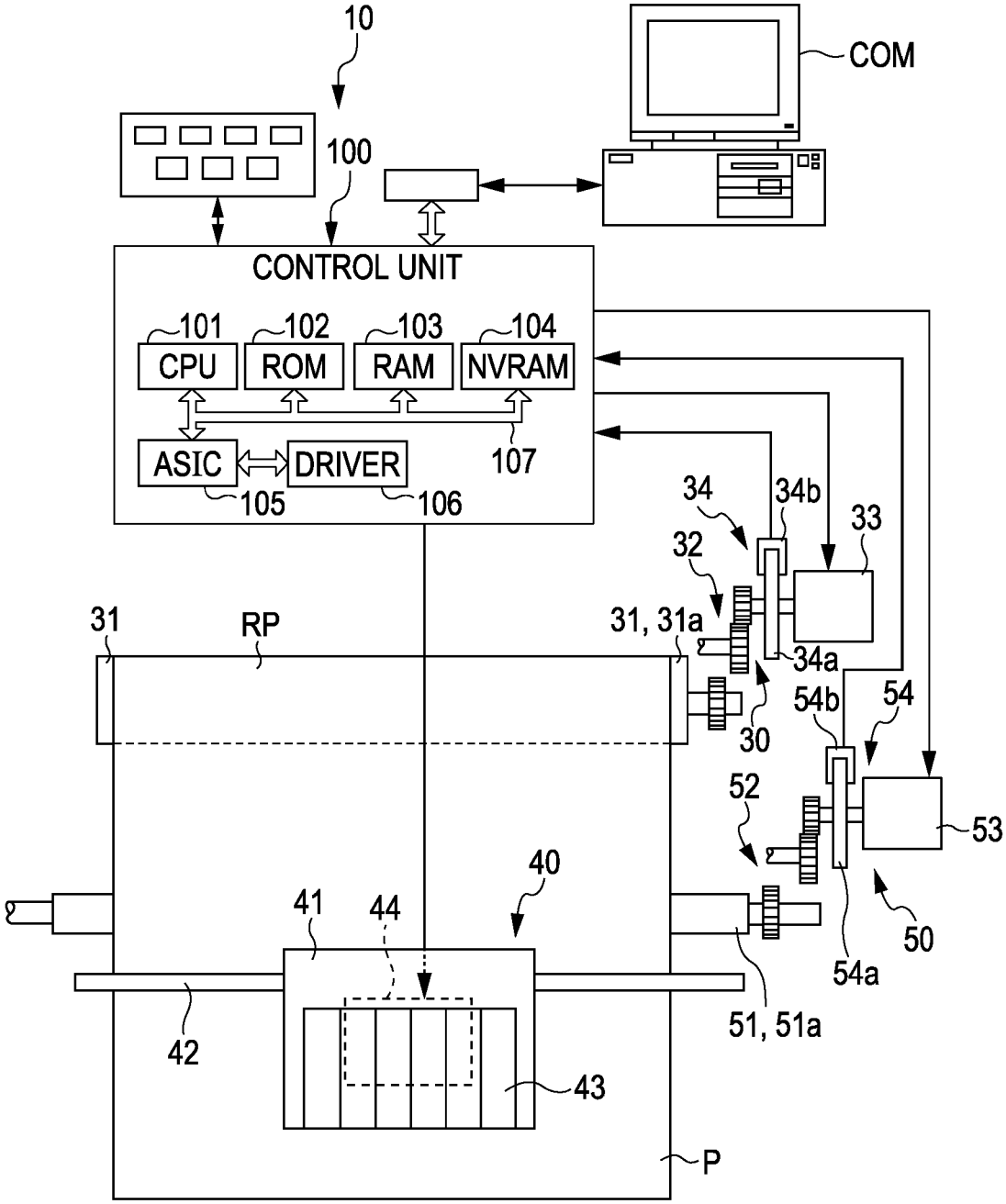
FIG. 2 is a diagram showing a schematic configuration of the printer shown in FIG. 1.

FIG. 1 is a perspective view showing an example of the external configuration of the printer 10 according to this embodiment. FIG. 2 is a diagram showing the relationship between a driving system, which uses a DC motor, and a control system of the printer 10 shown in FIG. 1. In this example, the printer 10 includes one pair of leg units 11, and a main body unit 20 that is supported by the leg units 11. In each leg unit 11, a support post 12 is disposed, and a caster 13 that can freely rotate is installed to a caster supporting section 14. Inside the main unit 20, various devices are mounted on a chassis (not shown), and the devices are covered with an external case 21. In addition, as shown in FIG. 2, in the main body unit 20, as a driving system that uses a DC motor, a roll driving mechanism 30, a carriage driving mechanism 40, and a paper transporting mechanism 50 are disposed.

Figure 3:
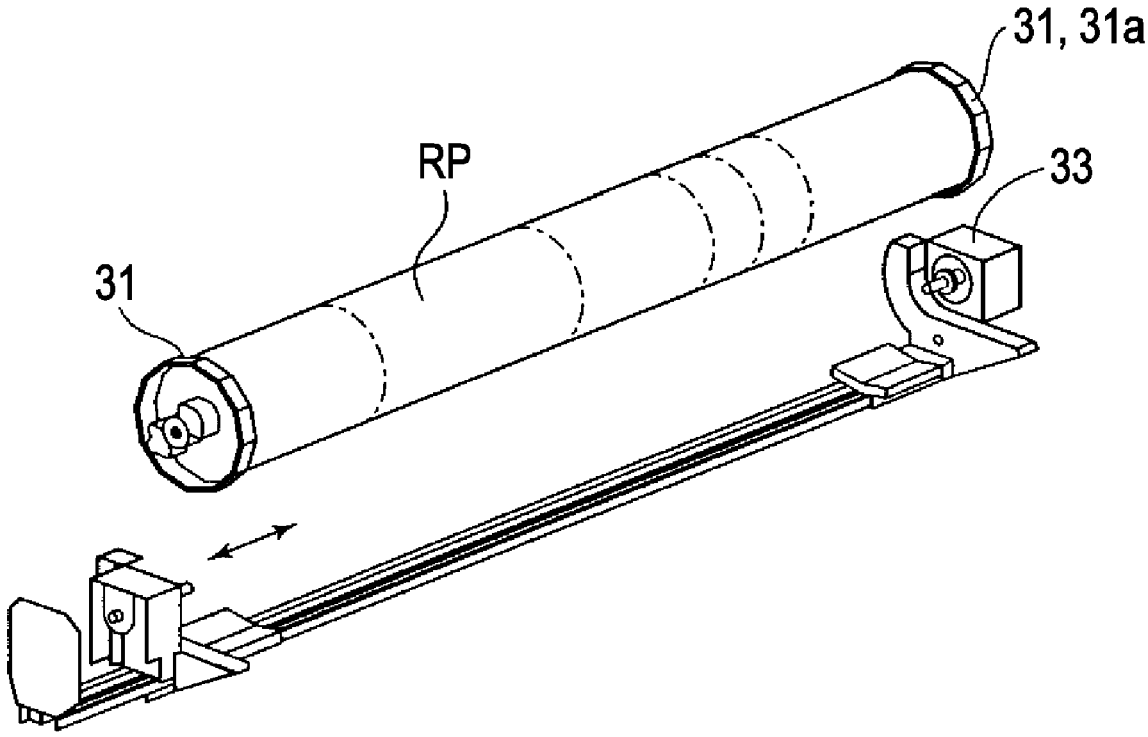
FIG. 3 is a perspective view showing the configuration of a rotary holder that holds a roll body according to the printer of FIG. 1.

The roll driving mechanism 30 is disposed in a roll mounting section 22 that is included in the main body unit 20. The roll mounting section 22, as shown in FIG. 1, is disposed on the rear face side of the main body unit 20 and the upper side thereof. By opening an opening/closing lid 23 that is an element constituting the above-described external case 21, a roll body RP is mounted on the inside of the roll mounting section 22, so that the roll body RP can be driven to rotate by the roll driving mechanism 30. In addition, the roll driving mechanism 30 that is used for rotating the roll body RP, as shown in FIGS. 2 and 3, includes a rotary holder 31, a gear wheel row 32, an RR motor 33, and a rotation detecting unit 34. FIG. 3 is a diagram showing an example of the external configuration of the rotary holder 31 and the RR motor 33. The rotary holder 31 is inserted from both the end sides of a hole RP1 that is formed in the roll body RP, and one pair of the rotary holders 31 is arranged so as to support the roll body RP from both the end sides.

The RR motor 33 as a first motor applies a driving force (rotation force) to a rotary holder 31*a*, which is located on one end side, of the one pair of the rotary holders 31 through the gear wheel row 32. In this embodiment, the rotation detecting unit 34 uses a rotary encoder. Accordingly, the rotation detecting unit 34 includes a disc-shaped scale 34*a* and a rotary sensor 34*b*. The disc-shaped scale 34*a* includes a light transmitting portion for transmitting light and a light shielding portion for blocking transmission of light which are disposed at constant intervals along the peripheral direction thereof. In addition, the rotary sensor 34*b* has a light emitting element, a light receiving element, and a signal processing circuit, which are not shown in the figure, as its principal constituent elements.

Figure 4A:
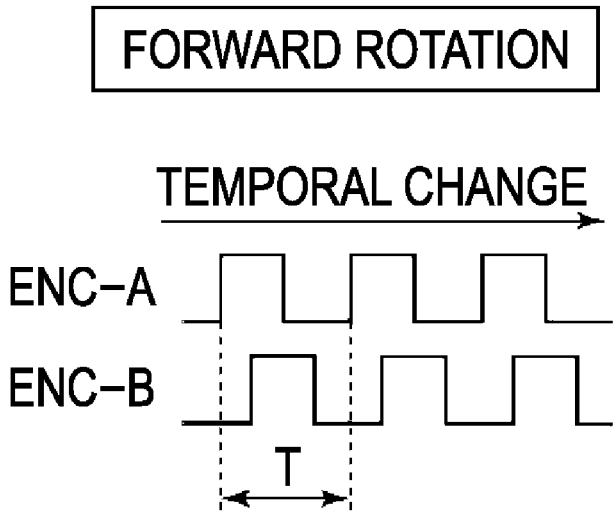
FIGS. 4A and 4B are diagrams showing an ENC signal, according to an embodiment of the invention.
Figure 4B:
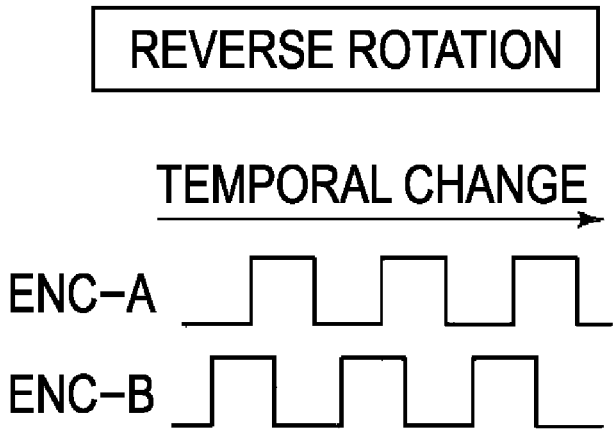

In addition, according to this embodiment, pulse signals (an ENC signal having the phase of A and an ENC signal having the phase of B), as shown in FIGS. 4A and 4B, having phases that are different from each other by 90 degrees are inputted to the control unit 100 in accordance with the output of the rotary sensor 34*b*. Accordingly, it can be detected whether the RR motor 33 is in the state of forward rotation or reverse rotation based on the lead or the delay of the phase. In addition, a carriage driving mechanism 40 is disposed in the main body unit 20. The carriage driving mechanism 40 includes a carriage 41 and a carriage shaft 42 that also form a part of the constituent element of the ink supplying and ejecting mechanism. In addition, the carriage driving mechanism 40 includes a carriage motor, a belt, and, the like, that are not shown in the figure.

The carriage 41 includes ink tanks 43 for storing ink (corresponding to fluid) of each color. Each ink tank 43 is configured so as to be supplied with ink from an ink cartridge (not shown in the figure), that is disposed to be fixed on the front face side of the main body unit 20, through a tube (not shown). In addition, as shown in FIG. 2, on the lower face of the carriage 41, ink heads 44 (corresponding to fluid ejecting heads) that can eject ink droplets are disposed. In the print head 44, a nozzle row, not shown in the figure, corresponding to the ink of each color is disposed. In each nozzle that forms the nozzle row, a piezo element (not shown), is disposed. By operating this piezo element, ink droplets can be ejected from the nozzle located in the end portion of an ink passage.

In addition, the ink supplying and ejecting mechanism is configured by the carriage 41, the ink tanks 43, tubes not shown in the figure, the ink cartridges, and the print heads 44. The driving type of the print head 44 is not limited to the piezo driving type in which a piezo element is used. Thus, for example, as the driving type of the print head 44; a heater driving type in which the force of generated bubbles is used; a magnetostriction driving type in which a magnetostrictor is used; or a mist driving type in which mists are controlled by an electric field, or the like, may be employed. In addition, the ink filled in the ink cartridge or the ink tank 43 may be any type of ink such as a dye-based ink type or a pigment-based ink type.

Figure 5:
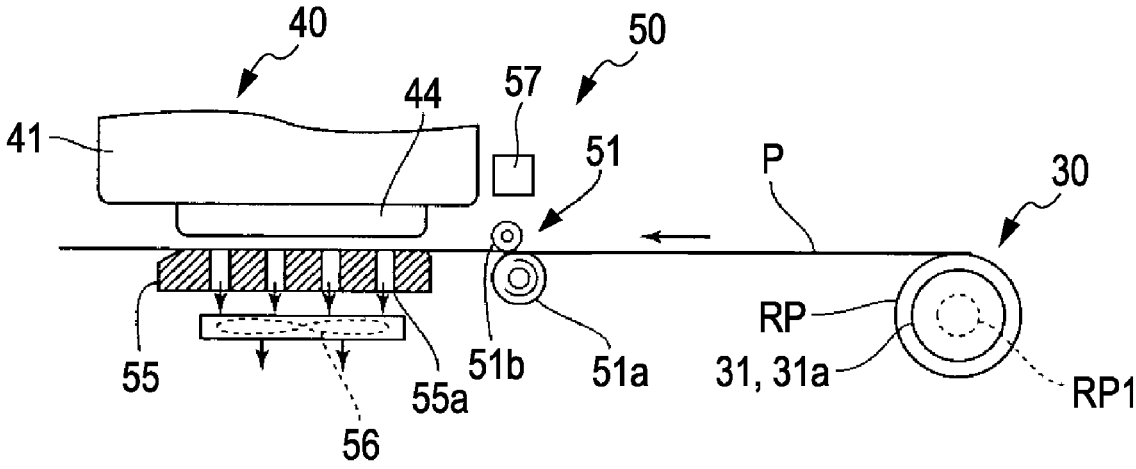
FIG. 5 is a diagram showing the positional relationship of a roll body, a transport roller pair, and a print head, according to an embodiment of the invention.

As shown in FIGS. 2 and 5, the paper transporting mechanism 50 includes a transport roller pair 51, a gear wheel row 52, a PF motor 53, and a rotation detection unit 54. FIG. 5 is a diagram showing the positional relationship of the roller body RP, the transport roll pair 51, and the print head 44. The transport roller pair 51 includes a transport driving roller 51*a* and a transport driven roller 51*b*. In addition, a paper sheet P (corresponding to a roll sheet) that is pulled out from the roller body RP is configured to be able to be pinched between the transport driving roller 51*a* and the transport driven roller 51*b*. In addition, the PF motor 53 as a second motor applies a driving force (rotation force) to the transport driving roller 51*a* through the gear wheel row 52. The rotation detecting unit 54 according to this embodiment uses a rotary encoder. The rotation detection unit 54, similar to the above-described rotation detecting unit 34, includes a disc-shaped scale 54*a* and a rotary sensor 54*b* so as to be able to output a pulse signal as shown in FIGS. 4A and 4B.

In addition, a platen 55 is disposed on the downstream side (paper discharging side) relative to the transport roller pair 51, and the paper sheet P is guided on the platen 55. In addition, the print head 44 is disposed so as to face the platen 55. In this platen 55, suction holes 55*a* are formed. The suction holes 55*a* are disposed so as to communicate with a suction fan 56. By operating the suction pan 56, air is sucked from the print head 44 side through the suction holes 55*a*. Accordingly, when a paper sheet P is placed on the platen 55, the paper sheet P can be sucked to be maintained thereon. In addition, the printer 10 includes other various sensors such as a paper width detecting sensor 57 that detects the width of the paper sheet P.

Figure 6:
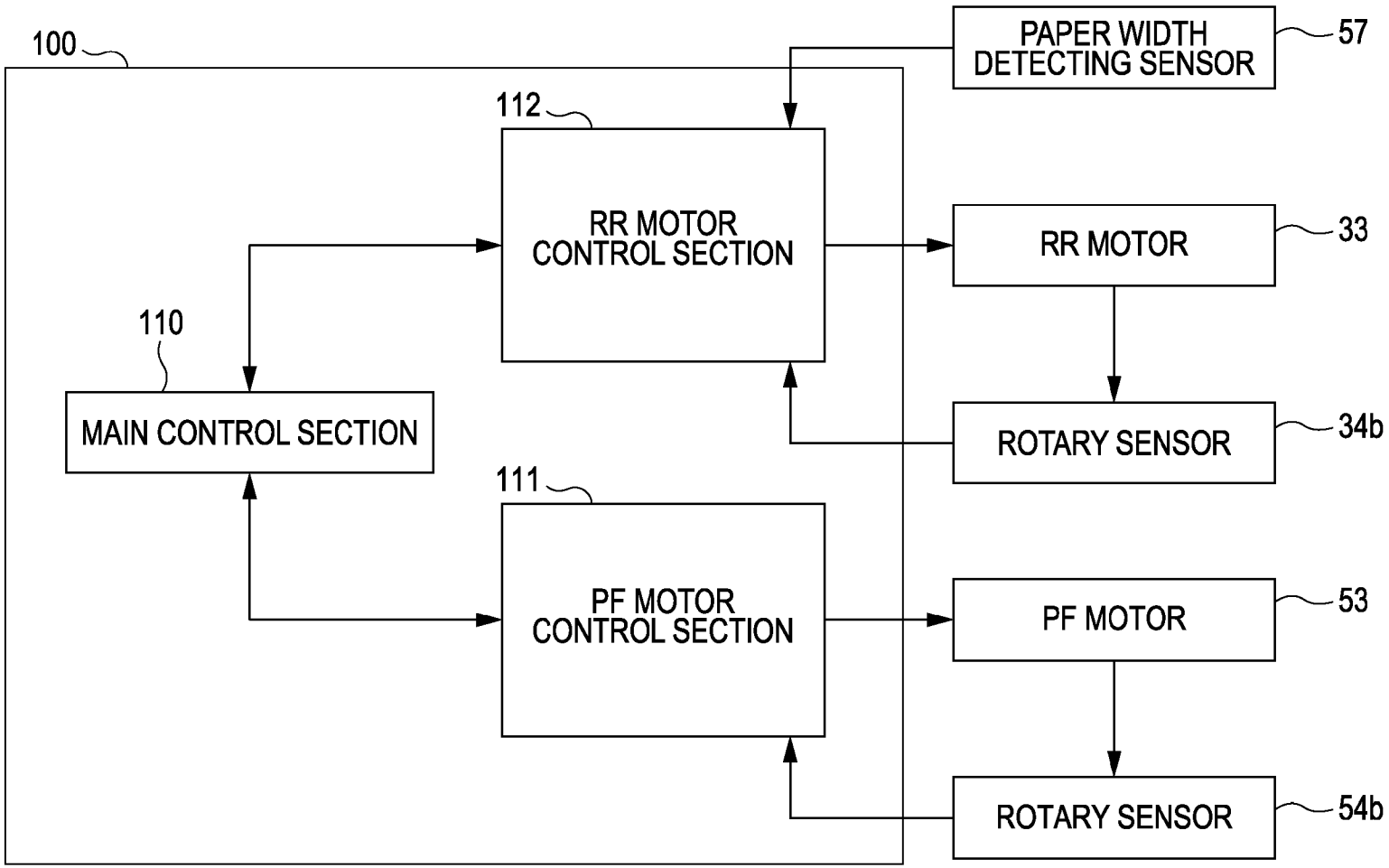
FIG. 6 is a block diagram showing an example of the configuration of a control unit, according to an embodiment of the invention.

FIG. 6 is a block diagram showing an example of the functional configuration of the control unit 100. To this control unit 100, various output signals of the rotary sensors 34*b* and 54*b*, a linear sensor not shown in the figure, the paper width detecting sensor 57, a gap detecting sensor not shown in the figure, an operation panel of the printer 10, and the like. As shown in FIG. 2, the control unit 100 includes a CPU 101, a ROM 102, a RAM 103, an NVRAM 104, an ASIC 105, and a motor driver 106. These components are interconnected through a transmission path 107 such as a bus. In addition, the control unit 100 is connected to the computer COM. The main control section 110, the PF motor control section 111, and the RR motor control section 112 as shown in FIG. 6 are implemented in cooperation of the above-described hardware, a ROM 102 or stored software and/or stored data or by adding a circuit or a constituent element that performs a unique process.

The PF motor control section 111 of the control unit 100 controls the driving of the PF motor 53 such that a paper sheet P is transported in the transport direction in accordance with rotation of the transport driving roller 51*a*. In the description below, the rotation direction of the PF motor 53, for a case where a paper sheet P is transported in the transport direction, is referred to as the forward rotation direction. The RR motor control section 112 as a control unit controls the driving of the RR motor 33 so as not to generate looseness of the paper sheet P. In addition, the rotation direction of the roll body RP in which a paper sheet P is started to be wound from is referred to as the forward rotation direction of the RR motor 33, and the rotation direction in which the paper sheet P is reversely wound is referred to as the reverse rotation direction. The main control section 110 controls the operations of the PF motor control section 111 and the RR motor control section 112. The control unit 100 performs processes to be described later in cooperation with the main control section 110, the PF motor control section 111, and the RR motor control section 112.

2-1. Entire Process

Figure 7:
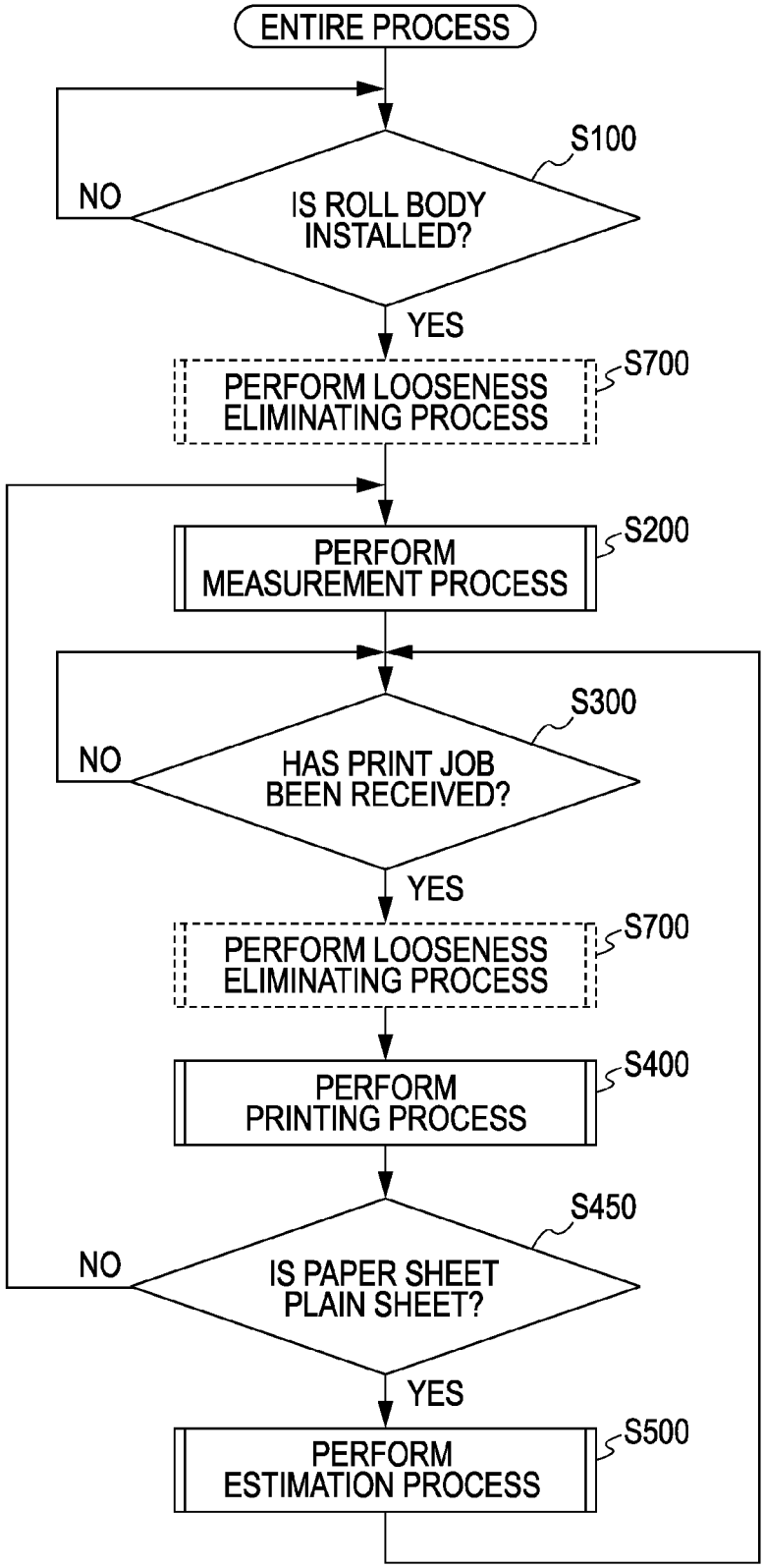
FIG. 7 is a flowchart showing the process performed by the printer, according to an embodiment of the invention.

FIG. 7 schematically shows the flow of the entire process that is performed by the printer 10 according to this embodiment. In Step S100, the control unit 100 detects that the roll body RP is installed to (replaced in) the roll mounting section 22. For example, the installation of the roller body RP to the roll mounting section 22 may be configured to be detected by using a sensor, not shown in the figure, or the installation of the roll body RP may be configured to be detected in accordance with the operation of an operation panel (not shown). In this embodiment, it is assumed that installation of the roll body RP and the type of a paper sheet P (for example, a plain sheet, a glossy sheet, or a matt sheet) that is wound around the roll body RP are received in the operation panel (not shown). The information that is used for identifying the type of the received paper sheet P is stored in the NVRAM 104. Next, the control unit 100 performs a measurement process in Step S200. In this measurement process, the diameter D of the roll body RP right after the installation of the roll body RP and the static load (torque) of rolling at the time when the roll body RP rotates are measured. The static load of rolling changes linearly in accordance with the rotation speed (the transport speed V of the paper sheet P) of the roll body RP, and thus, the static load Nhi of rolling at high-speed transport and the static load Nlo at low-speed transport are measured. When the above-described measurements are completed, the static loads Nlo and Nhi of rolling and the diameter D are stored in the NVRAM 104.

When the measurement process is completed, the printer 10 is in a state in which a printing operation can be performed, and the input of a print job is received from the computer COM in Step S300. In Step S400, a printing process for the received print job is performed. Then, when the printing process is completed, it is determined whether the paper sheet P of the installed roll body RP is a plain sheet (Step S450). When the paper sheet P is the plain sheet, an estimation process is performed in Step S500. In this estimation process, the diameter D of the roll body RP and the static loads Nlo and Nhi of rolling right after the printing process are acquired, and those stored in the NVRAM 104 are updated. When the estimation process is completed, the process returns to Step S300. On the other hand, when the paper sheet P of the installed roll body RP is not the plain sheet, the process returns to Step S200, and the measurement process is performed. In other words, by performing the measurement process, the static loads Nlo and Nhi of rolling and the diameter D are acquired so as to update those stored in the NVRAM 104.

As described above, according to this embodiment, first, in a stage in which the roll body RP is installed, the measurement process is performed, and the static loads Nlo and Nhi of rolling and the diameter D that are stored in the NVRAM 104 are updated each time the printing process is completed. However, when the paper sheet P of the installed roll body RP is the plain sheet, the static loads Nlo and Nhi of rolling and the diameter D are acquired by performing the measurement process for the first time, and are acquired by performing the estimation process thereafter. On the other hand, when the paper sheet P of the installed roll body RP is not the plain sheet, the static loads Nlo and Nhi of rolling and the diameter D are acquired by performing the measurement process each time. In addition, as denoted by broken lines, it is preferable that a looseness eliminating process (Step S700) is performed in advance before the measurement process and the printing process. In addition, there are cases where the printer 10 transports the paper sheet P in a process other than the printing process. For example, there may be a case where the paper sheet P is transported in a maintenance process. Even when such an operation is performed, in order to update the static loads Nlo and Nhi of rolling and the diameter D, it is preferable that the measurement process or the estimation process is performed. Next, the measurement process will be described.

2-2. Measurement Process

Figure 8:
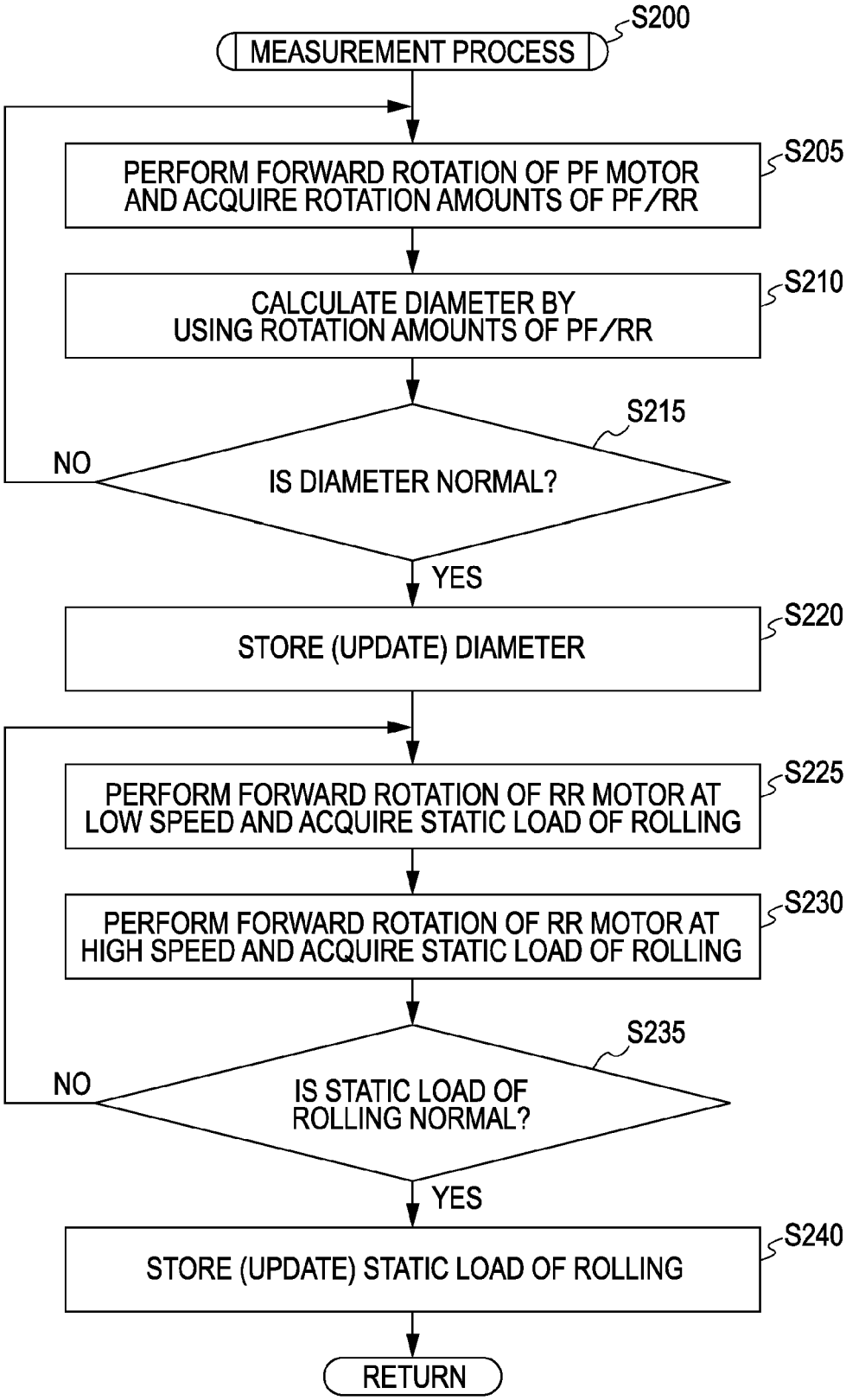
FIG. 8 is a flowchart showing a measurement process, according to an embodiment of the invention.

FIG. 8 shows the flow of the measurement process. In Step S205, the control unit 100 acquires outputs of the rotary sensors 34*b* and 54*b* while the PF motor control section 111 drives the PF motor 53 in the forward rotation direction. Although only the PF motor 53 is driven in the forward rotation direction, the paper sheet P of the roll body RP is transported in accordance with the driving of the PF motor 53. Accordingly, the roll body RP and the RR motor 33 are driven to rotate in the forward rotation direction as well.

Figure 9:
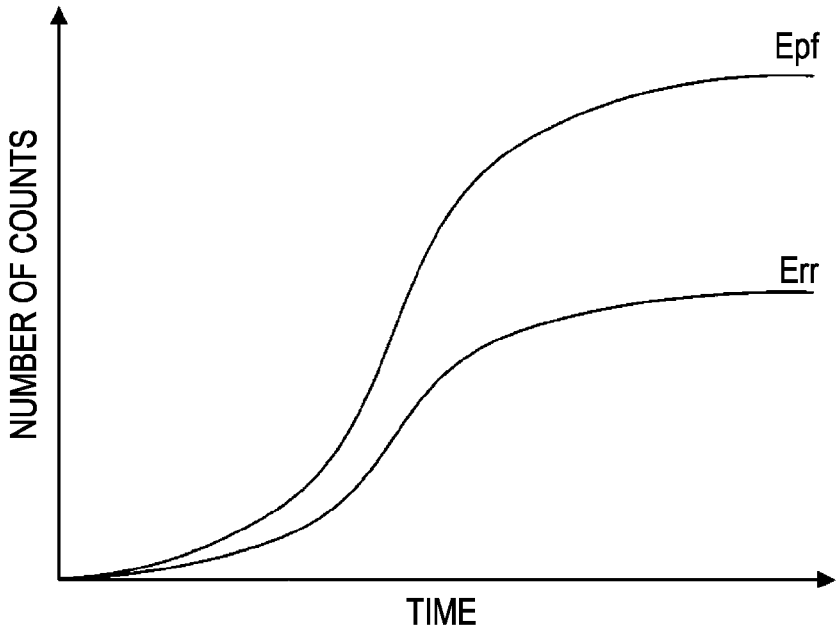
FIG. 9 is a diagram showing an output example of a rotary sensor, according to an embodiment of the invention.

FIG. 9 shows an example of the outputs of the rotary sensors 34*b* and 54*b* in Step S205. In the figure, a broken line represents the output of the rotary sensor 54*b* corresponding to the rotation amount of the PF motor 53, and a solid line represents the output of the rotary sensor 34*b* corresponding to the rotation amount of the RR motor 33. In addition, the horizontal axis denotes a time, and the vertical axis denotes the numbers of counts Err and Epf of the rotary sensors 34*b* and 54*b* in Step S205. These numbers of counts Err and Epf are the numbers of counts of edges of the above-described ENC signals and represent the rotation amounts of the rotary sensors 34*b* and 54*b* in Step S205. As shown in FIG. 9, the PF motor 53 is driven so as to be accelerated over the former period of the driving process to the intermediary period and be slowly decelerated thereafter to be finally stopped. Since the RR motor 33 is driven in accordance with the movement of the PF motor 53, the output of the rotary sensor 34*b* is the same as that of the PF motor 53.

In Step S210, the numbers of counts Err and Epf of the rotary sensors 34*b* and 54*b* are acquired after a predetermined time elapses from starting the driving operation in Step S205, and the diameter D of the roll body RP is calculated based on the numbers of counts. Here, extension or slip of the paper sheet P can be ignored mostly. Thus, it can be considered that the transport amount ΔLpf of the paper sheet P, that is transported in accordance with the rotation of the PF motor 53 in Step S205, and the transport amount ΔLrr of the paper sheet P, that is transported in accordance with the rotation of the RR motor 33, are the same. In addition, the transport amounts ΔLpf and ΔLrr of the paper sheet P are in proportion to the numbers of counts Err and Epf of the rotary sensors 34*b* and 54*b*. When proportionality coefficients are k1 and k2, the following Equation 1 is satisfied.

$$\Delta Lpf = k1 \times Epf$$

$$\Delta Lrr = k2 \times Err$$

$$\Delta Lpf = \Delta Lrr \quad (1)$$

The proportionality coefficient k1 for the PF motor 53 is a constant number corresponding to the reduction gear ratio of the gear wheel row 52, the diameter of the transport driving roller 51*a*, the circumference ratio, and the like. Since the diameter D of the roll body RP is decreased in accordance with the transport of the paper sheet P, the proportionality coefficient k2 for the RR motor 33 becomes a coefficient that is in proportion to the diameter D of the roll body RP. When the proportionality coefficient k2 is broken down into a constant number k3 (a constant number corresponding to the reduction rear ratio of the gear wheel row 32, the circumferential ratio, and the like) and the diameter D, the above-described Equation 1 can be represented as the following Equation 2, and whereby the diameter D can be calculated.

$$\Delta Lrr = k3 \times D \times Err$$

$$k1 \times Epf = k3 \times D \times Err \quad (2)$$

Here, k1 and k3 are existing constant numbers. Thus, when the above-described Equation 2 is solved with respect to the diameter D, the diameter D can be calculated based on the numbers of counts Err and Epf. In Step S215, it is determined whether the calculated diameter D is a normal value. When the calculated diameter D is a normal value, the diameter D is stored in the NVRAM 104 in Step S220. On the other hand, when the calculated diameter D is not a normal value, the process of Step S205 is performed again. In addition, in such a case, the process may be configured to end while notifying an error.

In Step S225, the RR motor control section 112 drives the RR motor 33 to rotate in the forward rotation direction so as to send out the paper sheet P at a constant transport speed of Vlo. Then, in Step S225, in a period in which the transport speed V of the paper sheet P is stabilized at the transport speed of Vlo, the control unit 100 acquires the static load Nlo of rolling by converting the Duty of the PWM signal that is output to the RR motor 33 from the RR motor control section 112 into a torque. According to this embodiment, PID control is performed with the transport speed of Vlo set as the target, and the static load Nlo of rolling is acquired by converting the average value of integral components of the PID control value. In addition, the transport speed V of the paper sheet P can be acquired by dividing the above-described transport amount ΔLrr by the time. Accordingly, the PID control with the transport speed of Vlo set as the target can be performed.

In Step S230, the RR motor control section 112 drives the RR motor 33 in the forward rotation direction so as to send out the paper sheet P at a constant transport speed Vhi (>Vlo). Then, in a period in which the transport speed V of the paper sheet P is stabilized at the transport speed of Vhi, a duty value of the PWM signal that is output from the RR motor control section 112 to the RR motor 33 is acquired as the static load Nhi of rolling, similarly to Step S225. Here, the static loads Nlo and Nhi of rolling can be thought to be values corresponding to loads needed for rotating the roller body RP at rotation speeds corresponding to the transport speeds of Vlo and Vhi in resistance against the rotational resistance (mainly the frictional resistance).

Figure 10:
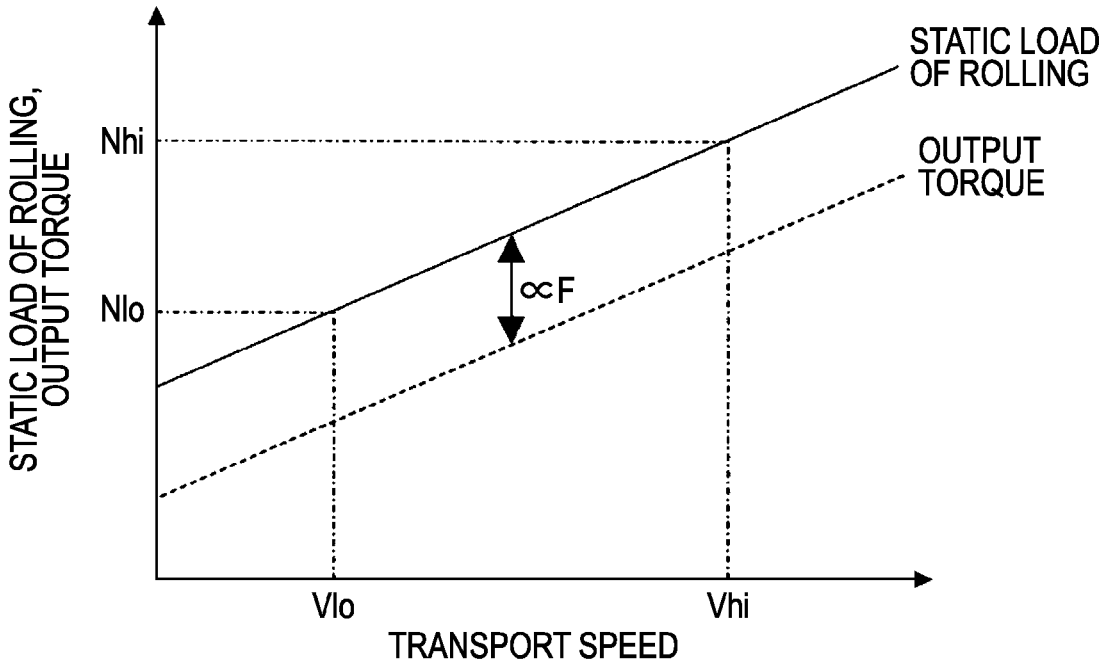
FIG. 10 is a graph showing the relationship between a transport speed and a static load of rolling, according to an embodiment of the invention.

FIG. 10 shows an example of the relationship between an arbitrary transport speed V and a static load N of rolling. As shown the figure, the static load N of the rolling can be represented as a linear function of the transport speed V. Accordingly, when at least the duty values Nlo and Nhi at the transport speeds Vlo and Vhi are known, the static load N of rolling corresponding to any arbitrary transport speed V can be calculated by using the following Equation 3.

$$N = \frac{(Nhi - Nlo)}{(Vhi - Vlo)} V + \left\{ Nlo - \frac{(Nhi - Nlo)}{(Vhi - Vlo)} Vlo \right\} \quad (3)$$

In Step S235, it is determined whether the values of the static loads Nlo and Nhi of rolling are normal. When the values are normal, the static loads Nlo and Nhi of rolling are stored in the NVRAM 104 in Step S240, and the measurement process is completed. On the other hand, when the values are not normal, the process is performed from Step S230 again. According to the measurement process described above, the diameter D of the roll body RP and the static loads Nlo and Nhi of rolling can be measured and stored in the NVRAM 104. In addition, as described above, when the paper sheet P of the roll body RP is not a plain sheet, the measurement process is performed each time the printing process is performed, and the diameter D and the static loads Nlo and Nhi of rolling are sequentially updated. Next, the estimation process will be described.

2-3. Estimation Process

Figure 11:
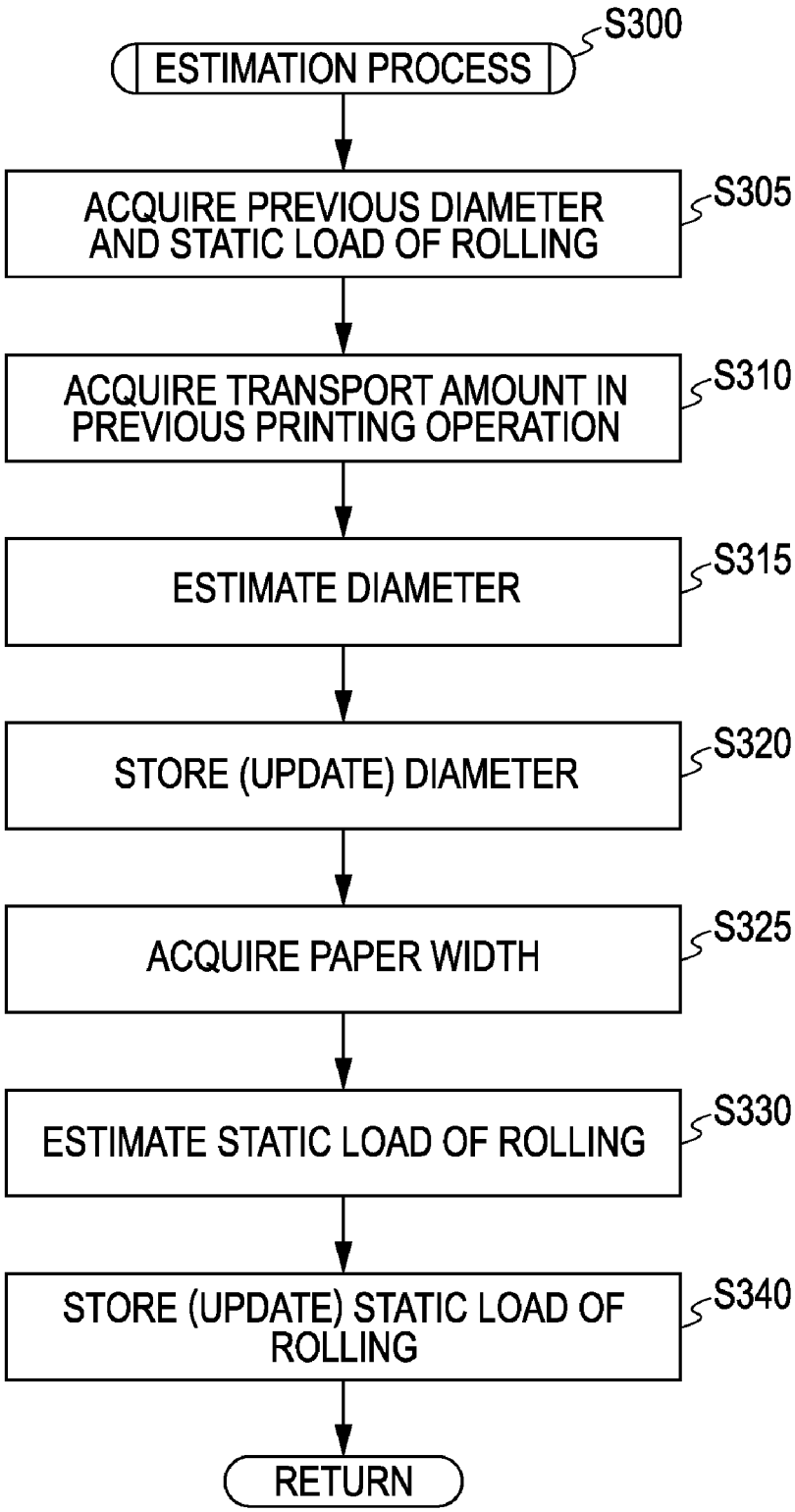
FIG. 11 is a flowchart showing an estimation process, according to an embodiment of the invention.

FIG. 11 shows the flow of the estimation process. In Step S305, the diameter D of the roll body RP that is currently stored in the NVRAM 104 is acquired. The diameter D of the roll body RP that is currently stored in the NVRAM 104 means the diameter D (hereinafter, denoted as a reference diameter D0) of the roll body RP before the prior printing process. As a condition for performing the estimation process as shown in FIG. 7, there is a premise that the paper sheet P of the roll body RP is a plain sheet. In Step S310, the transport amount ΔL (ΔLpf) of the paper sheet P that is transported in the prior printing process is acquired. In each printing operation, the print size for the transport direction is designated, and accordingly, the transport amount ΔL of actual transportation in the printing process can be acquired. It is apparent that an accumulated value of the number of counts of the rotary sensor 54*b* in the printing process may be converted into the transport amount ΔLpf by using Equation 1. In Step S315, the current diameter D of the roll body RP is estimated based on the relationship (first correspondence relationship CR1) between the diameter D of the roll body RP and the remaining amount L of the paper sheet P that is wound around the roll body RP.

Figure 12:
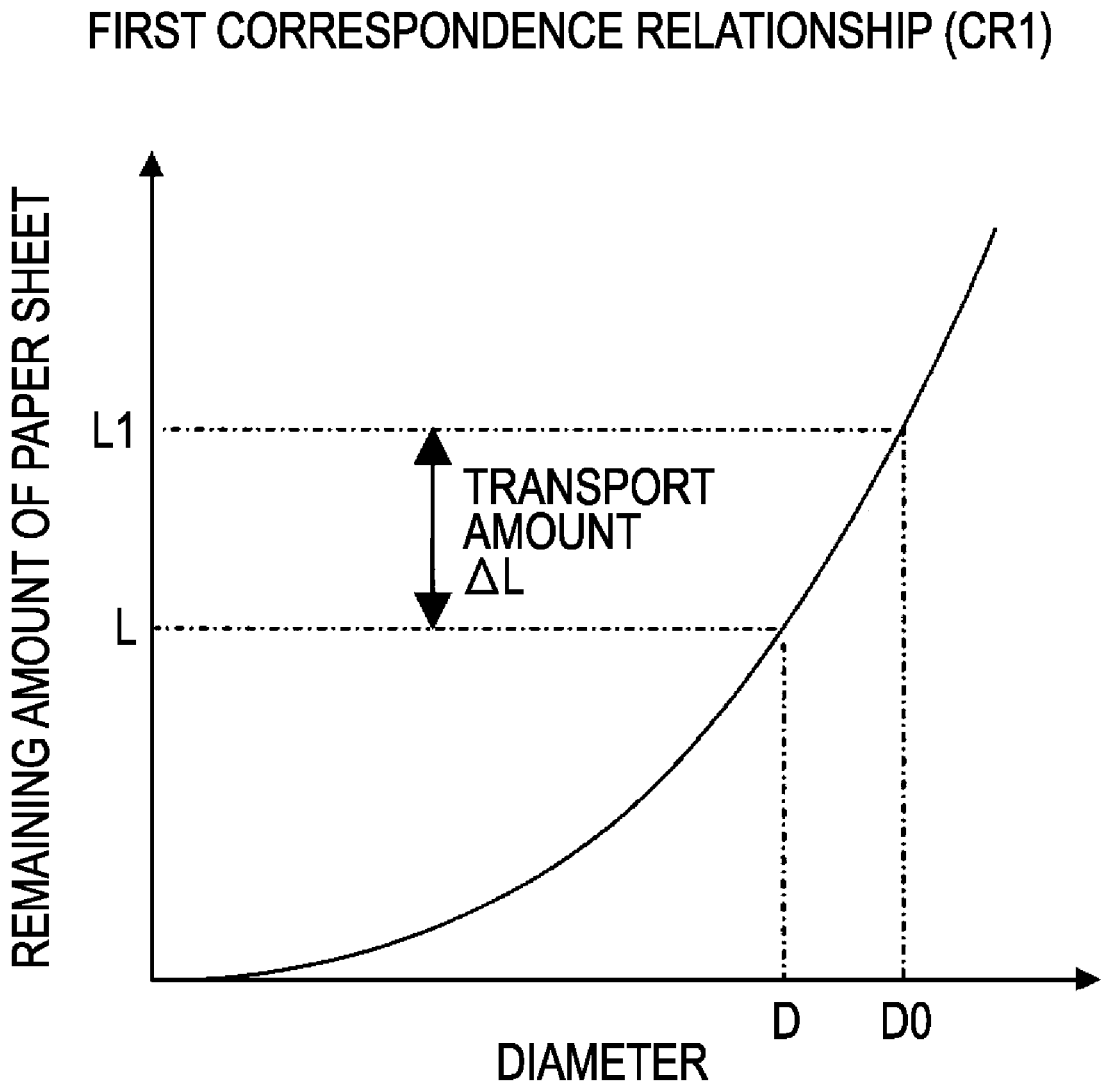
FIG. 12 is a graph showing the first correspondence relationship, according to an embodiment of the invention.

FIG. 12 shows an example of the above-described first correspondence relationship CR1. The vertical axis represents the remaining amount L of the paper sheet P that is wound around the roll body RP, and the horizontal axis represents the diameter D of the roll body RP. As shown, the first correspondence relationship CR1 can be represented by a parabola (quadratic function) of the diameter D of the roll body RP. When the current diameter D of the roll body RP is estimated, first, the remaining amount L (hereinafter, denoted by a reference remaining amount L1) of the paper sheet P, corresponding to the reference diameter D0 of the roll body RP before the prior printing process which is acquired in Step S305, is calculated based on the first correspondence relationship CR1. Then, by subtracting the transport amount ΔL acquired in Step S310 from the reference remaining amount L1, the current remaining amount L (hereinafter, denoted by the remaining amount L2) of the paper sheet P is calculated. Subsequently, the diameter D corresponding to the current remaining amount L2 of paper sheet P is calculated based on the first correspondence relationship.

Accordingly, the current diameter D of the roll body RP can be estimated. In addition, a function parameter that defines the first correspondence relationship (quadratic function) CR1 is stored in the ROM 102 in advance, and the parameter is accessed so as to be used in Step S315. In Step S320, the estimated diameter D is stored in the NVRAM 104 so as to update the diameter. Next in Step S325, the control unit 100 acquires the measured value w of the paper width that is measured by the paper width detecting sensor 57. Then, in Step S330, the static loads Nlo and Nhi of rolling for a case, where the current roll body RP is rotated at a rotation speed corresponding to the transport speeds Vlo and Vhi, are estimated based on the correspondence relationship (the second correspondence relationships CR2*a* and CR2*b*) between the diameter D of the roll body RP and the static loads Nlo and Nhi of rolling.

Figure 13:
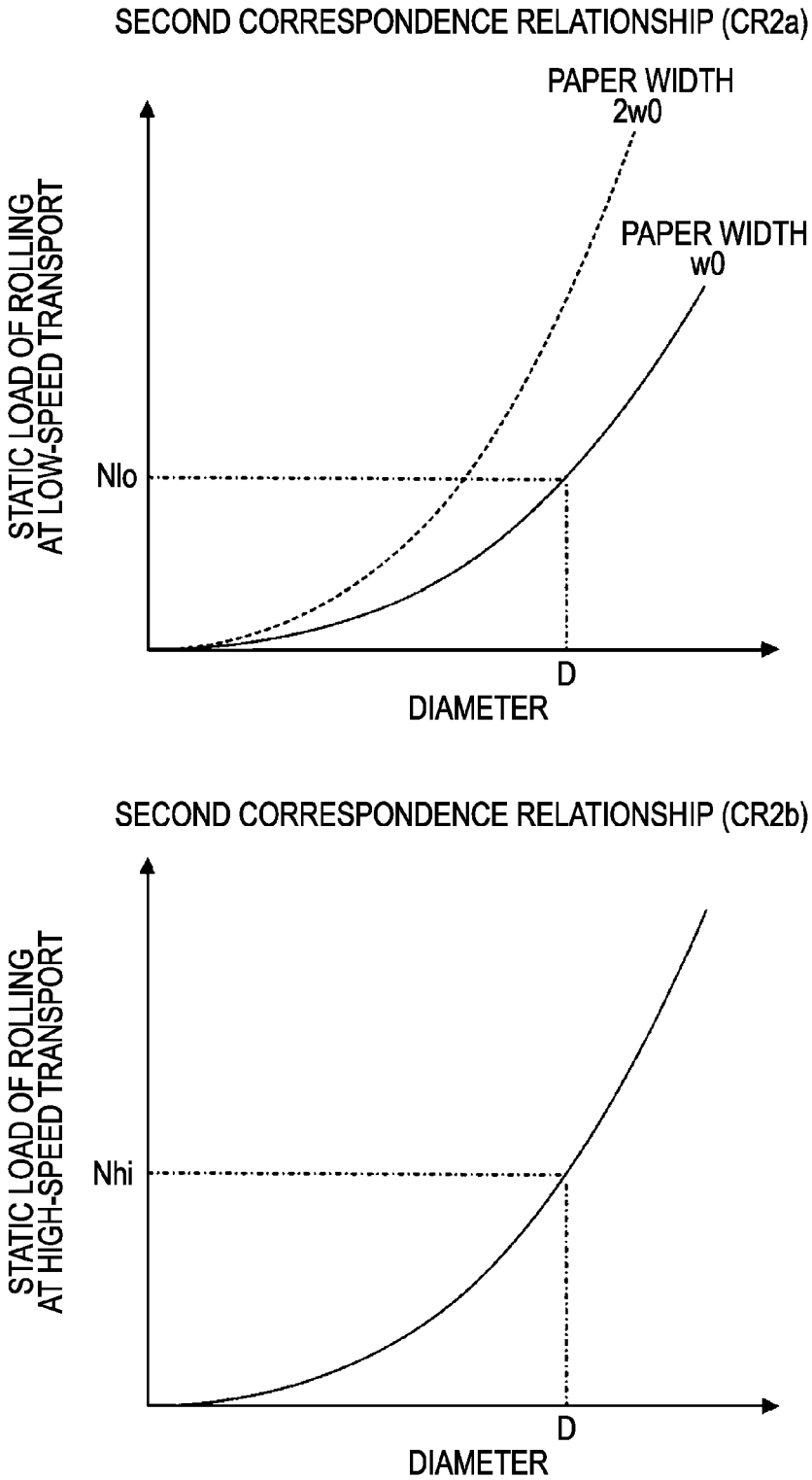
FIG. 13 is a graph showing the first correspondence relationship, according to an embodiment of the invention.

FIG. 13 shows the second correspondence relationships CR2*a* and CR2*b*. In the figure, the vertical axis represents the static loads Nlo and Nhi of rolling, and the horizontal axis represents the diameter D of the roll body RP. The second correspondence relationships CR2*a* and CR2*b* (denoted by solid lines) represent the static loads Nlo and Nhi of rolling for a case where the roll body RP, around which the paper sheet P having a reference paper width w0 is wound, is driven at the transport speeds Vlo and Vhi. As shown in the figure, the second correspondence relationships CR2*a* and CR2*b* can be represented by a parabola (quadratic function) of the diameter D of the roll body RP. The reason for this is that when the diameter D of the roll body RP is decreased, the weight of the roll body RP is decreased so as to reduce the frictional resistance.

In addition, the static loads Nlo and Nhi of rolling can be thought to be in proportion to the paper width w. For example, when the paper width w is twice the reference width w0, the static loads Nlo and Nhi of rolling have double magnitudes, as denoted by broken lines in the static load Nlo of rolling. When the static loads Nlo and Nhi of rolling for an arbitrary paper width w are to be acquired, the static loads Nlo and Nhi of rolling, which are denoted by solid lines, are multiplied by a paper width ratio w/w0. The current diameter D of the roll body RP is acquired in Step S315, and thus, the static loads Nlo and Nhi (solid lines) corresponding to the diameter D in the second correspondence relationships CR2*a* and CR2*b* are calculated in Step S330. Then, by multiplying the static loads Nlo and Nhi of rolling by the above-described paper width ratio w/w0, the static loads Nlo and Nhi of rolling for the actual paper width w can be estimated. In Step S335, the static loads Nlo and Nhi of rolling estimated as above are stored in the NVRAM 104 for update.

The above-described first correspondence relationship CR1 and the second correspondence relationships CR2*a* and CR2*b* are prepared based on theoretical equations or preliminary experiments, and are prepared only for a plain sheet in this embodiment. Accordingly, estimation can be made only for a case where the paper sheet P of the installed roll body RP is the plain sheet by performing the estimation process. When the printing process is performed for the plain sheet, the request for shortening a time that is needed for printing is high. Thus, according to this embodiment, the time needed for printing is shortened by performing the estimation process for the plain sheet. It is apparent that the first correspondence relationship CR1 and the second correspondence relationships CR2*a* and CR2*b* are also prepared for a glossy sheet or a matt sheet, and the estimation process may be configured to be performed by using the first correspondence relationship CR1 and the second correspondence relationships CR2*a* and CR2*b* corresponding to the type of the loaded paper sheet P. Even when the measurement process is performed or the estimation process is performed, the current diameter D of the roll body RP and the static loads Nlo and Nhi of rolling after performing the printing process can be acquired, and the current (latest) diameter D of the roll body RP and the static loads Nlo and Nhi of rolling can be stored in the NVRAM 104. Accordingly, the printing process to be described later can be performed by using the current (latest) diameter D of the roll body RP and the static loads Nlo and Nhi of rolling. Next, the printing process will be described.

2-4. Printing Process

Figure 14:
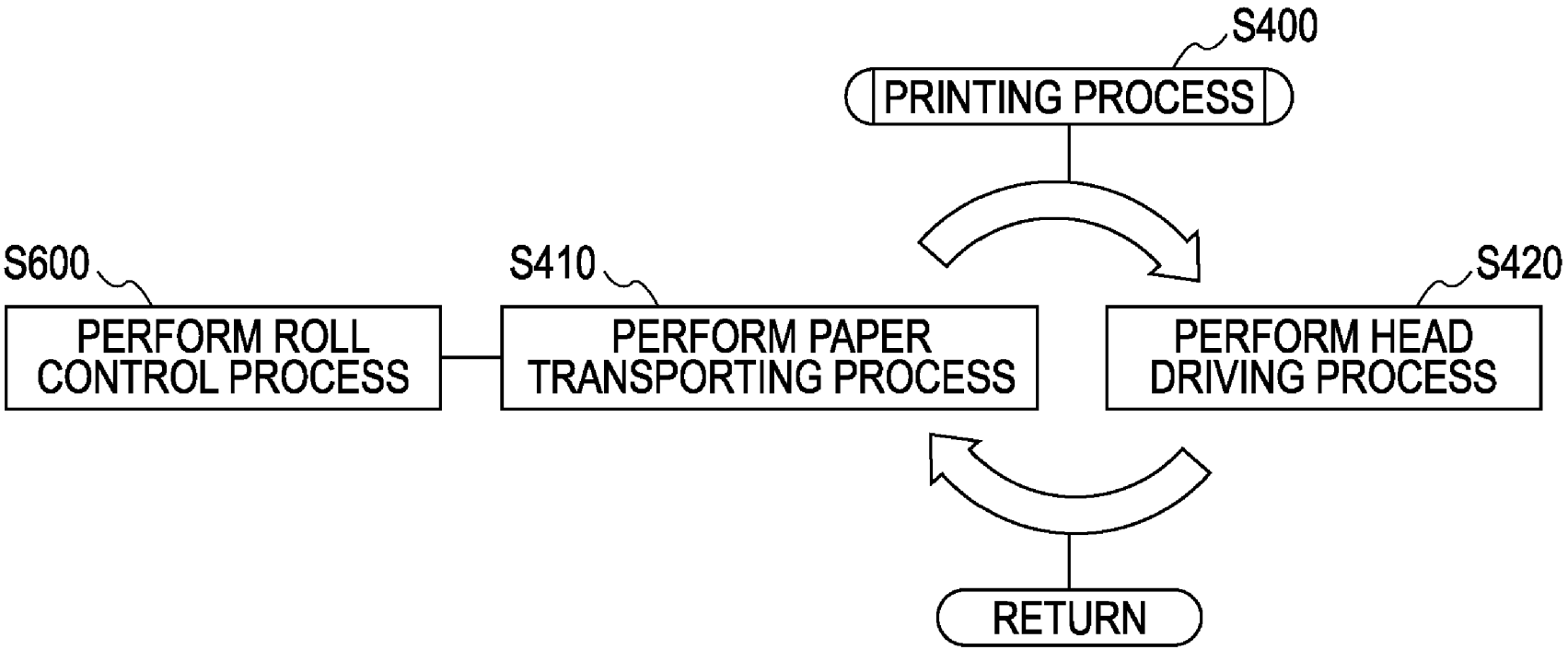
FIG. 14 is a flowchart showing a printing process, according to an embodiment of the invention.

FIG. 14 shows the flow of the printing process. As shown in the figure, the printing process is performed by alternating a paper transporting process (Step S410) and a head driving process (Step S420). In the paper transporting process, the PF motor control section 111 of the control unit 100 controls driving of the PF motor 53 such that the paper sheet P is transported in the transport direction by rotating the transport driving roller 51*a*. In each paper transporting process, a length (corresponding to the above-described transport amount ΔL; denoted by a target transport amount ΔLt) of the paper sheet P to be transported is designated, and the driving control for transporting the paper sheet P by the target transport amount ΔLt is performed for the PF motor 53. According to this embodiment, when the needed target transport amount ΔLt is designated based on print data (print job), a speed mode of a transport speed V that is appropriate to transportation of the target transport amount ΔLt is selected. According to this embodiment, speed modes of VM1 to VM4 can be selected. In each of the speed modes VM1 to VM4, PID control is performed with 5 ips, 3 ips, 1 ips, or 0.15 ips set as the maximum transport speed V. Basically, as the target transport amount ΔLt is increased, the speed mode having a higher speed is selected from among the speed modes VM1 to VM4.

On the other hand, in the head driving process (Step S420), ink droplets are ejected from a plurality of nozzles, that are disposed in the print head 44, while the print head 44 is scanned in a direction perpendicular to the transport direction of the paper sheet P in a state in which the paper sheet P is stopped. Accordingly, ink dots can be formed on the paper sheet P. The ink dots can be arranged in two-dimensional directions by performing the paper transporting process and the head driving process alternately, and whereby a planar image can be formed on the paper sheet P. When all the paper transporting processes and the head driving processes are completed, the process returns to the main flow shown in FIG. 7, and the measurement process (for a paper sheet other than a plain sheet) or the estimation process (for a plain sheet) is performed. According to this embodiment, the roll control process is performed in parallel with each sub scanning process (Step S410). Hereinafter, the roll control process (Step S500) will be described in detail.

2-5. Roll Control Process

Figure 15:
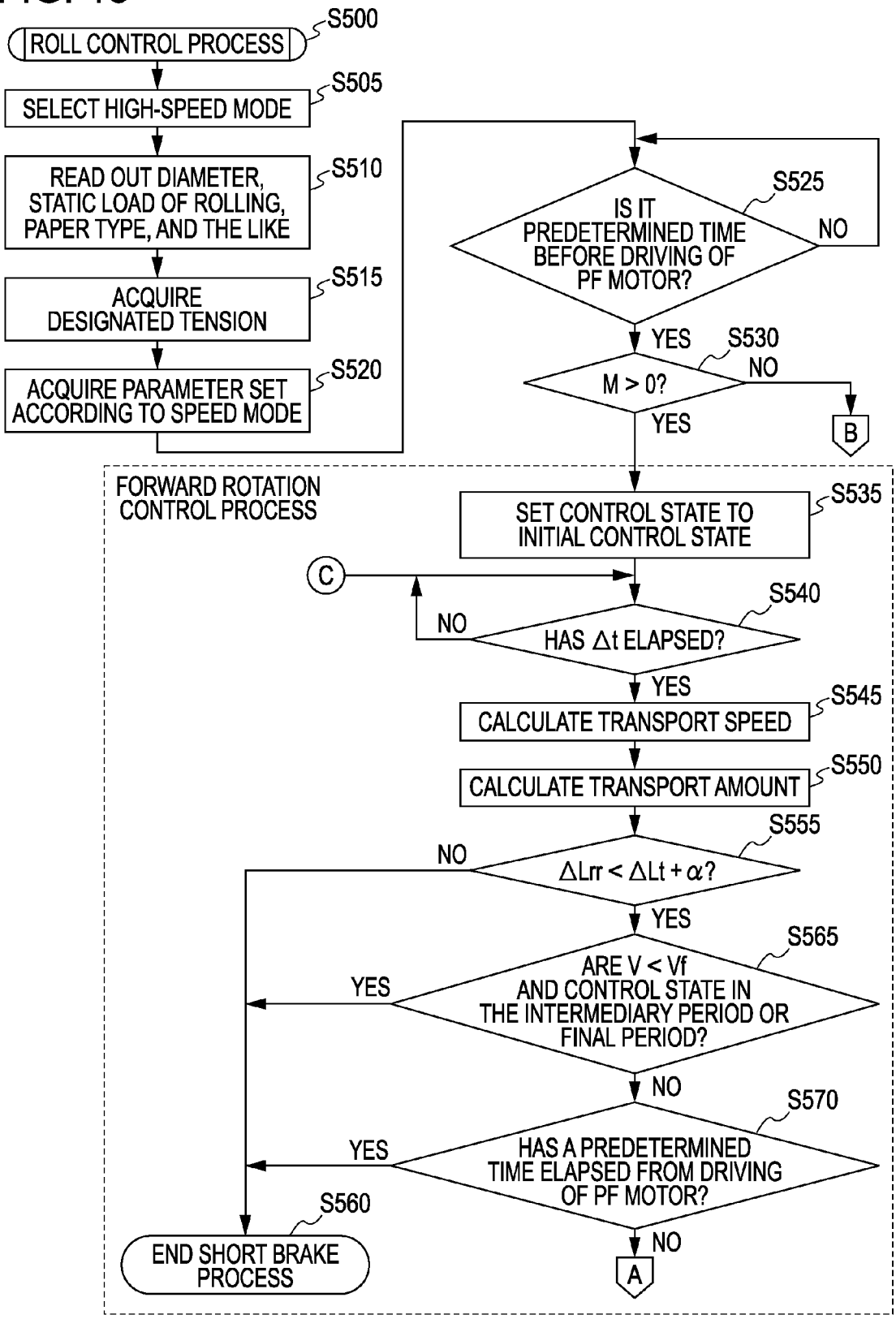
FIG. 15 is a flowchart showing a roll control process (first half), according to an embodiment of the invention.
Figure 16:
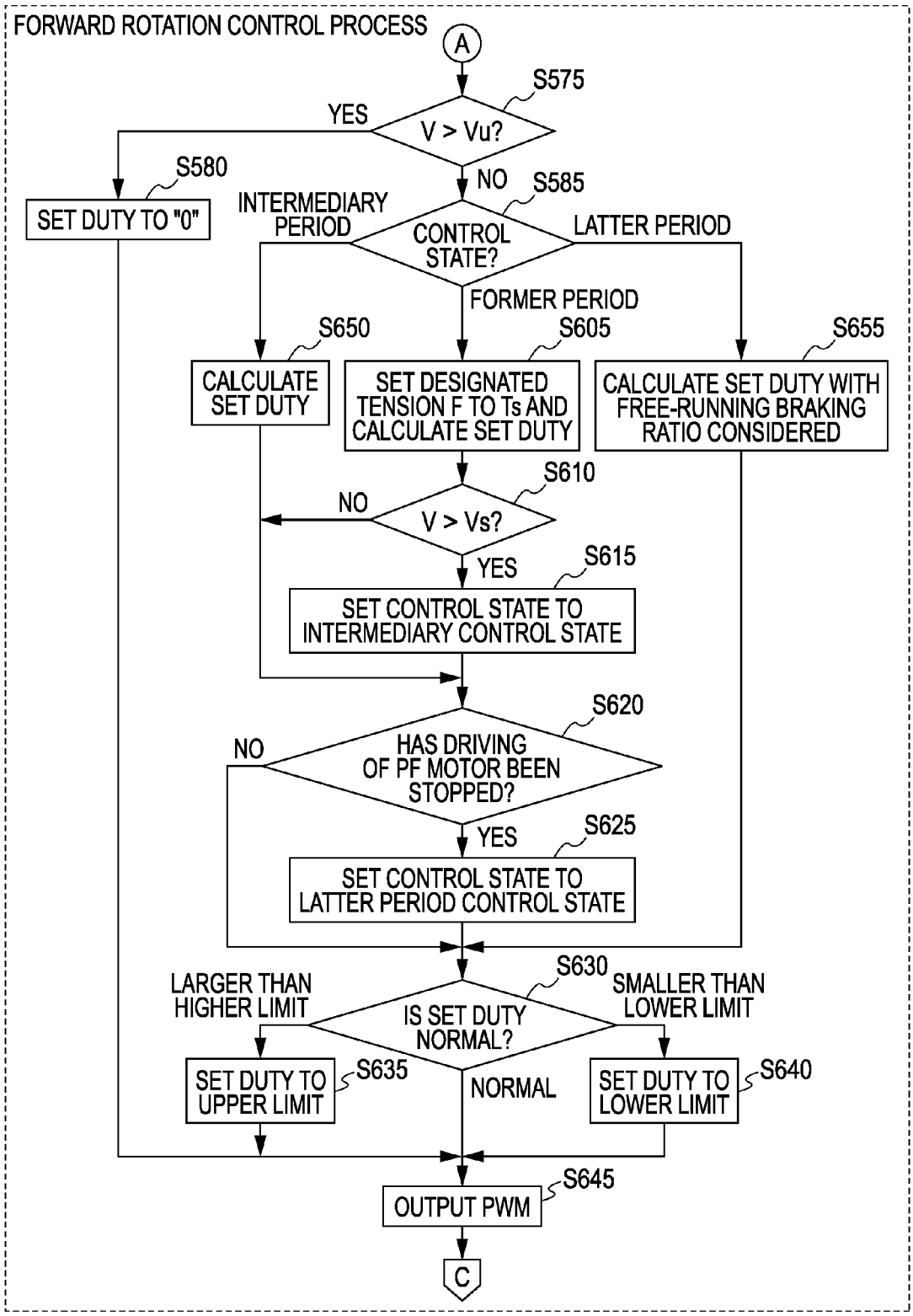
FIG. 16 is a flowchart showing a roll control process (forward rotation control process), according to an embodiment of the invention.
Figure 17:
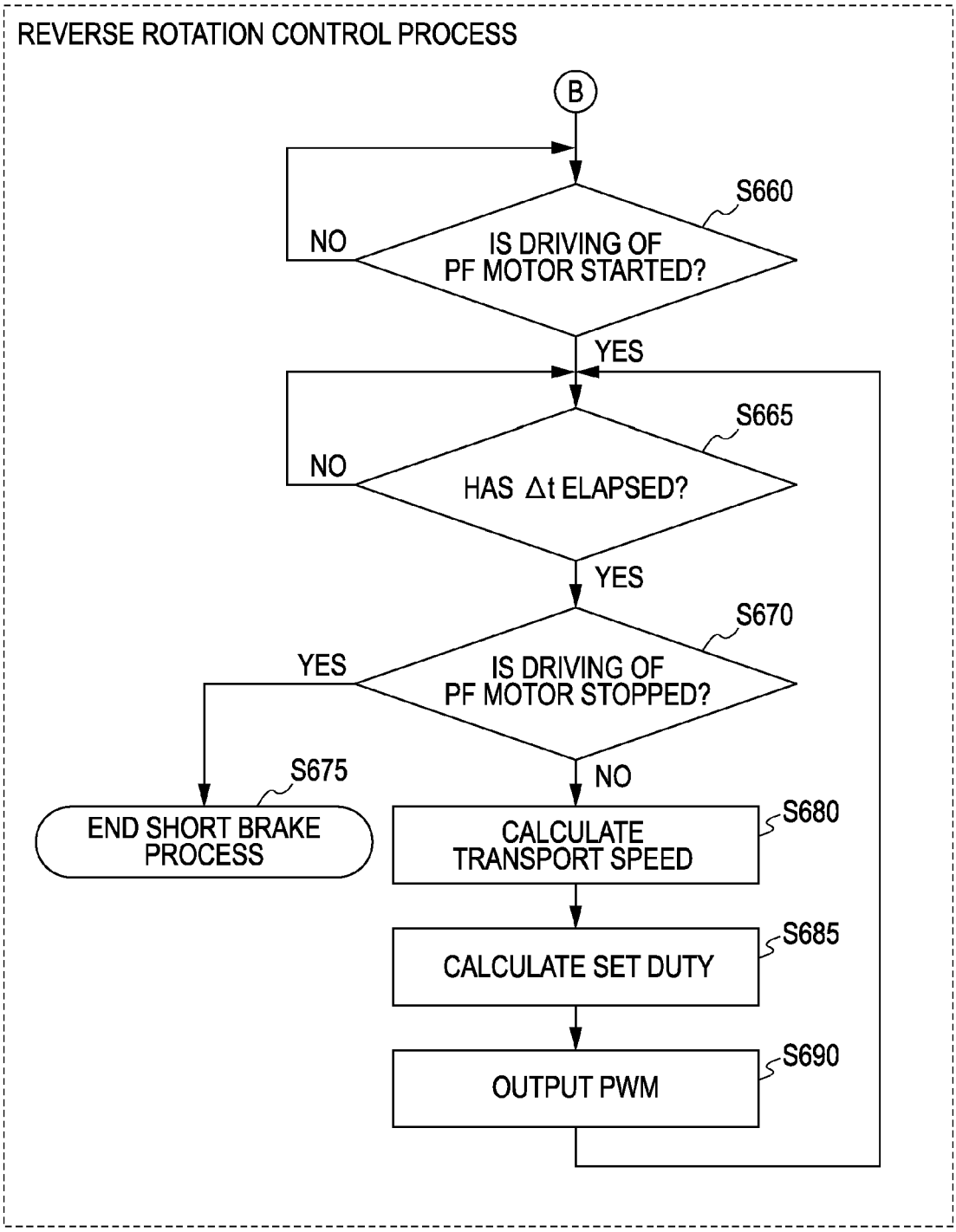
FIG. 17 is a flowchart showing a roll control process (reverse rotation control process), according to an embodiment of the invention.

FIGS. 15 to 17 show the process of the roll control process. As described above, the paper transporting process is alternately performed with the head driving process, and accordingly, driving of the PF motor 53 is performed intermittently. The roll control process is performed in synchronization with each driving process (stop-driving-stop) of the PF motor 53. The start timing of the roll control process is after the driving of the PF motor 53 is stopped in the previous paper transporting process and before driving of the PF motor 53 is started in the current paper transporting process. The end timing of the roll control process is changed based on the processing content. When the roll control process ends, the RR motor control section 112 sets the output torque M of the RR motor 33 to "0" and applies a short brake to the RR motor 33. Accordingly, basically the RR motor 33 stops for a period, in which the PF motor 53 is not driven, so as to generate a predetermined braking force. In other words, the RR motor 33, similarly to the PF motor 53, is driven intermittently. In addition, in the short braking process, the driving force is converted into an induction current by shorting the coil of the motor, and whereby the driving force is lost. The Duty of the PWM signal that is output to the RR motor 33 in the roll control process is updated, and the RR motor 33 is driven at the output torque M (driving force) corresponding to the Duty.

When the roll control process is started, the target transport amount ΔLt in the (current) paper transporting process (Step S410) that is synchronously performed in Step S505 is acquired by the RR motor control section 112, and the speed mode VM1 to VM4 is selected by using a selection technique that is the same as that used in the paper transporting process. In other words, the speed mode VM1 to VM4 that is the same as that of the paper transporting process (Step S410) performed in a parallel manner is selected. In Step S510, the RR motor control section 112 reads out the diameter D of the roll body RP, the static loads Nlo and Nhi of rolling, and the type of the paper sheet P from the NVRAM 104. In other words, the diameter D of the roll body RP prior to the printing process that is currently performed, the static loads Nlo and Nhi of rolling, and the type of the paper sheet P are acquired. In Step S515, designated tension F corresponding to the type of the paper sheet P acquired in Step S510 is acquired. Described more precisely, unitary designated tension f per unit width is acquired, and by multiplying the unitary designated tension f by the paper width w, the designated tension F=f×w is acquired.

Figure 18:
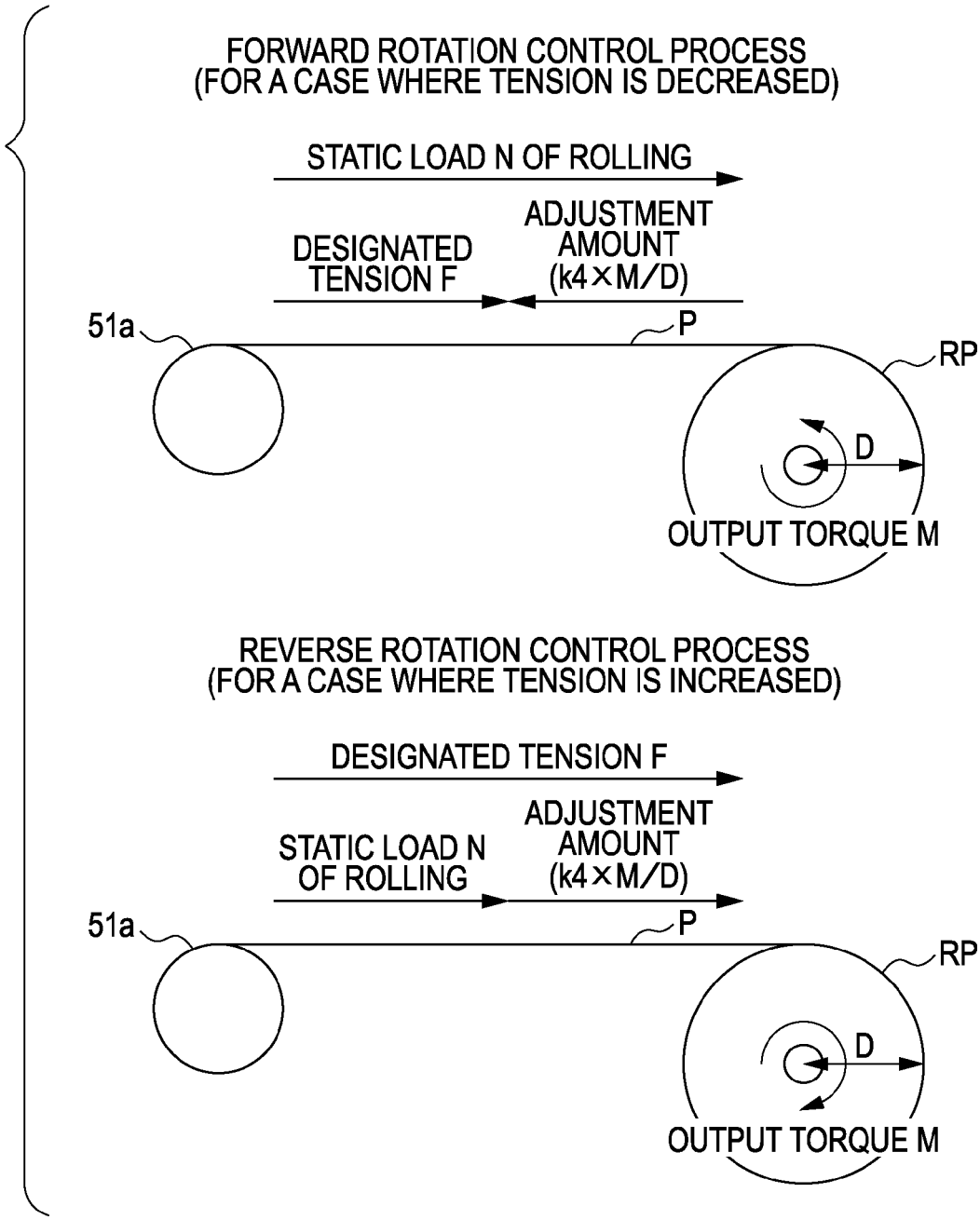
FIG. 18 is a schematic diagram showing forces applied to a paper sheet, according to an embodiment of the invention.

FIG. 18 schematically shows the concept of the designated tension F. In the figure, the relationship of the roll body RP, the transport roller pair 51, and the paper sheet P is shown. In the paper transporting process, the PF motor control section 111 drives the transport driving roller 51*a* (does not drive the RR motor 33), and whereby the paper sheet P is transported at a predetermined transport speed V. Then, the roll body RP is rotated forwardly in a driven manner so as to be pulled toward the paper sheet P, and the torque of the static load N of rolling for rotating the roll body RP is generated around the driving shaft (the rotation shaft of the roll body RP) of the RR motor 33. Tension applied to the paper sheet P located on the surface of the roll body RP can be denoted by T, in order to transport the paper sheet P with the static load N of rolling, which is applied to the rotation shaft of the resisting roll body RP. Tension T, which satisfies the following Equation 4, is generated based on the symmetry of the moment around the rotation shaft of the roll body RP.

$$T \times D = k4 \times N \qquad (4)$$

$$T = k4 \times \frac{N}{D}$$

In other words, in a state in which the paper sheet P is transported at a predetermined transport speed V without driving the RR motor 33, the tension T satisfying the above-described Equation 4 is applied. Here, k4 is a proportionality constant and can be determined based on the diameter of the rotation shaft of the roll body RP and the like. The relationship between the transport speed V and the static load N of rolling needed for rotating the roll body RP can be determined based on the static loads Nlo and Nhi that are acquired in the measurement process or the estimation process that is performed in advance and the above-described Equation 3. Accordingly, the tension T that is generated in a case where the paper sheet P is transported at an arbitrary transport speed V without driving the RR motor 33 can be determined.

Next, a case where the RR motor 33 is driven will be considered. When the PF motor control section 111 performs the PWM output for the RR motor 33, and the RR motor 33 generates the output torque M in the forward rotation direction, a torque acquired by subtracting the output torque M from the static load N of rolling is applied around the rotation shaft of the roll body RP. In such a case, the following Equation 5 can be acquired based on the above-described Equation 4.

$$T \times D = k4 \times (N - M) \qquad (5)$$

$$T = k4 \times \frac{(N - M)}{D}$$

As represented by Equation 5 shown above, by forwardly rotating (M>0) the RR motor 33 while the paper sheet P is transported, the tension T applied to the paper sheet P can be decreased. In addition, the magnitude (adjusted amount) of the tension T is decreased by the output torque M to be k4×M/D. On the contrary, when a negative output torque M (the reverse rotation direction) is applied to the RR motor 33, the tension T can be increased. Here, when the tension T is too large, the amount of slip between the transport driving roller 51*a* and the paper sheet P is increased, and accordingly, the intended transport amount ΔL cannot be achieved. The amount of slip is in proportion to the tension T. On the other hand, when the tension T is too small, the roll body RP is forwardly rotated unintentionally, and whereby the looseness of the paper sheet P is generated. As a result, the tension T needs to be managed to have an appropriate magnitude.

Thus, according to this embodiment, the value of the target tension T is set as the designated tension F. By substituting the designated tension F in the above-described Equation 5, the output torque M of the RR motor 33 that is needed for achieving the designated tension F can be calculated. In addition, the diameter D of the roll body RP and the static loads Nlo and Nhi of rolling that are used in the above-described Equation 5 are updated after each printing process is performed, and accordingly, the output torque M can be calculated correctly. When the above-described relationship is represented in FIG. 10, the output torque M (broken line) of the RR motor 33 that is needed for achieving the designated tension F can be denoted by a straight line that is parallel to the static load N (solid line) of rolling that linearly increases in proportion to the transport speed V.

$$\text{Duty}=k5\times M \tag{6}$$

In addition, as in the above-described Equation 6, the duty value (Duty) of the PWM signal for generating the output torque M is in proportion to the output torque M, and accordingly, control for implementing the designated tension F can be performed by the RR motor control section 112. Here, k5 corresponds to a proportionality constant that is used for normalizing the Duty. In addition, the mechanical characteristics of the paper sheet P are different depending on the type of the paper sheet P, and accordingly, the designated tension F is prepared for each type of the paper sheet P and is stored in the ROM 102 in advance. Accordingly, the designated tension F corresponding to the type of the paper sheet P that is acquired in Step S510 can be acquired in Step S515. In addition, the frictional coefficient is different depending on the type of the paper sheet P, and accordingly, the amount of slip corresponding to the tension T is different. Therefore, the designated tension F for achieving an appropriate amount of slip is set in accordance with the frictional coefficient of each paper sheet P. For a thick paper sheet P, a large force is needed for deformation to be started to be wound on a plane from the wound state, and it is preferable that the designated tension F is set to be larger than that for a thin paper sheet P.

Figure 19A:
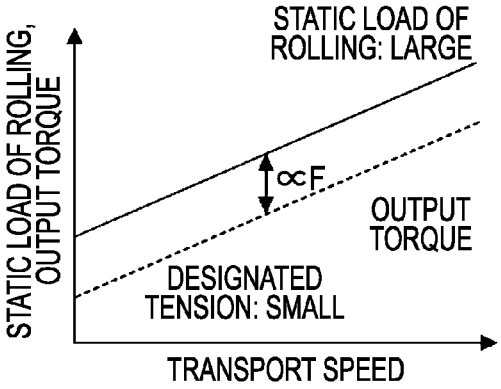
FIGS. 19A to 19D are graphs showing the relationship between designated tension, a static load of rolling, and an output torque, according to an embodiment of the invention.
Figure 19B:
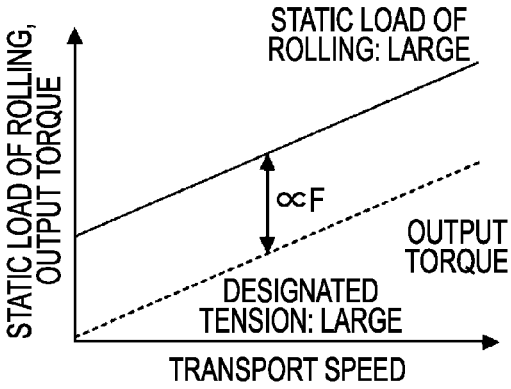
Figure 19C:
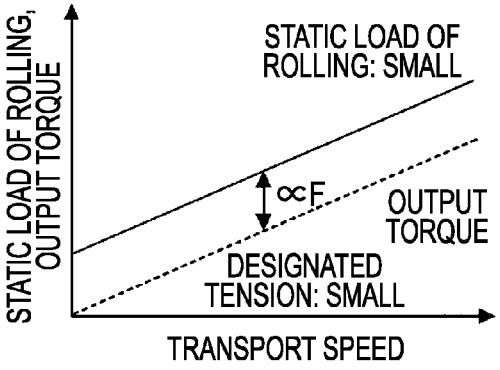
Figure 19D:
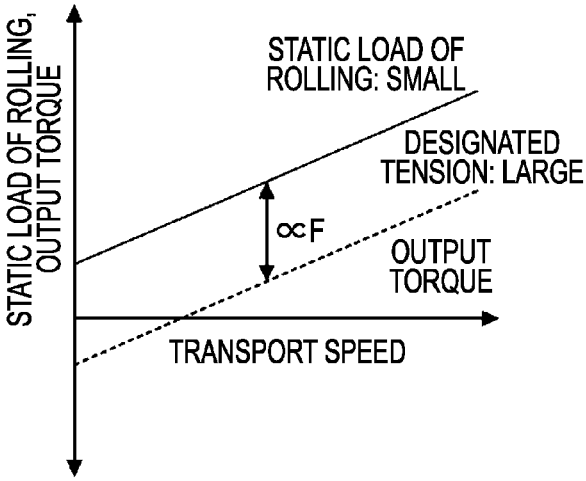

FIGS. 19A to 19D show examples of the relationship of the designated tension F, the static load N of rolling, and the output torque M. As shown in FIG. 19D, when the static load N of rolling is small and the designated tension F is large, the output torque M for achieving the designated tension F may have a negative value. In such a case, by outputting the output torque M (M<0) for the reverse rotation direction, the load around the rotation shaft of the roll body RP is increased. In Step S520, the control parameter set corresponding to the speed mode VM1 to VM4 that is determined in Step S505 is acquired from the ROM 102. In the ROM 102, a parameter table PT in which the control parameter set is stored for each speed mode VM1 to VM4.

FIG. 20 shows an example of the parameter table PT. As shown in the figure, in the parameter table PT, a transport speed upper limit Vu, a transport amount limiting value α, a free-running braking ratio b, a control transferring transport speed Vs, a control completing transport speed Vf, and initial tension Ts for each speed mode VM1 to VM4 are stored as control parameters. When the control parameter set corresponding to the speed mode VM1 to VM4 is acquired, the parameters needed for the roll control process are mostly acquired.

In Step S525, the PF motor control section 111 determines whether it is a predetermined time before (for example, several milliseconds before; denoted by ta) the time when the driving of the transport driving roller 51*a* is started in the paper transporting process (Step S410) that is performed synchronously, and waits until it becomes the predetermined time ta before the start time. In addition, also during this period, the RR motor control section 112 sets the output torque M (Duty) of the RR motor 33 to "0" and applies a short brake to the RR motor 33. When it becomes the predetermined time ta before the start time, it is determined whether the output torque M for achieving the designated tension F at the transport speed V=0 is positive in Step S530. In particular, the static load N of rolling at the transport speed V=0 is calculated by substituting the transport speed V=0 in the above-described Equation 3. Then, by substituting the static load N of rolling and the designated tension F in the above-described Equation 5, the output torque M of the RR motor 33 is calculated. Subsequently, it is determined whether the output torque M is positive.

A process (Steps S535 to S645; hereinafter, denoted by a forward rotation control process) for a case, where the output torque M for achieving the designated tension F at the transport speed V=0 is determined to be positive, in Step S530, that is, a case for driving the roll body RP in the forward rotation direction for relieving the tension T up to the designated tension F, will be described. The forward rotation control process is a looping process for updating the Duty that is output to the RR motor 33 by the RR motor control section 112 during the next minute time Δt each time when the minute time Δt synchronized with a predetermined clock signal elapses. The forward rotation control process is divided into three control states of an initial-period control state, an intermediary-period control state, and a latter-period control state. The Duty is updated by using a different technique in each control state. In addition, the time when the forward rotation control process is started is a predetermined time before the PF motor control section 111 starts to drive the transport driving roller 51*a*.

In Step S535, the control state is set to the initial-period control state. In Step S540, the elapse of a predetermined time Δt is waited for. In the next step S545, the transport speed V of the printing medium P that is transported by the roll body RP during the previous time Δt is calculated. This transport speed V can be acquired by calculating the transport amount ΔLrr during the time Δt by using the above-described Equation 2 and dividing the transport amount ΔLrr by the time Δt. In Step S550, the transport amount ΔLrr of the paper sheet P that is transported by the roll body RP up to this point in time after the forward rotation control process is calculated. Here, the transport amount ΔLrr is calculated by substituting the number of counts Err of the rotary sensor 34*b* up to this point in time after the forward rotation control process is started into the above-described Equation 2.

In Step S555, the upper limit of the transport amount is calculated by adding a value acquired by multiplying the transport amount limiting value α, that is acquired from the parameter table PT by the current transport speed V, and the period (time) of the encoder to the target transport amount ΔLt in the paper transporting process (Step S410), that is performed in a synchronized manner. Then, it is determined whether the upper limit of the transport amount is larger than the transport amount ΔLrr. When the transport amount ΔLrr is larger than the upper limit of the transport amount, a short brake is applied to the RR motor 33 in Step S560, and the roll control process (forward rotation control process) is completed. Accordingly, the RR motor 33 is in a state in which the short brake is applied until a next roll control process is started. In other words, when the transport amount ΔLrr transported by the roll body RP is larger than the target transport amount ΔLt, that is estimated for a case where the transport driving roller 51*a* is transported, it is determined that looseness is generated in the paper sheet P between the transport driving roller 51*a* and the roll body RP. Accordingly, in such a case, the short brake is applied to the RR motor 33 so as not to further generate the looseness in the proper sheet P. In addition, a different transport amount limiting value α can be set in accordance with each speed mode VM1 to VM4, and accordingly, the upper limit of the transport amount ΔLrr that is appropriate to the speed modes VM1 to VM4 can be set. In addition, according to this embodiment, the same transport amount limiting value α is set for each speed mode VM1 to VM4. However, the transport amount limiting value α may be set to a different value in accordance with each speed mode VM1 to VM4.

In Step S565, it is determined whether the transport speed V calculated in Step S545 is lower than the control completing transport speed Vf, that is acquired from the parameter table PT, and whether the control state is the intermediary-period control state or the latter-period control state. When the transport speed V is smaller than the control completing transport speed Vf and the control state is the intermediary-period control state or the latter-period control state, a short brake is applied to the RR motor 33 in Step S560, and the roll control process (forward rotation control process) is completed. On the other hand, in a case where the control state is the intermediary-period control state, or the latter-period control state other than the initial-period control state, that corresponds to the control state before driving of the transport driving roller 51*a*, or the initial period of driving, when the transport speed V is lower than the control completing transport speed Vf, it can be determined that driving of the transport driving roller 51*a* is in the final period of deceleration or is stopped already.

In such a case, when the output torque M corresponding to the forward rotation of the roll body RR is output to the RR motor 33, the RR motor 33 forwardly rotates independently, and looseness of the paper sheet P between the transport driving roller 51*a* and the roll body RP is generated. Accordingly, when the transport speed V is lower than the control completing transport speed Vf, a short brake is applied so as to complete the roll control process. As shown in FIG. 20, the control completing transport speed Vf is set to a value that is smaller for the speed mode VM4 in which the maximum transport speed V is relatively low. In the speed mode VM4, even in a period other than a period in which driving of the transport driving roller 51*a* is to be stopped, the transport speed V may be decreased. Thus, by decreasing the control completing transport speed Vf, completion of the roll control process at a timing that is not intended can be prevented.

In Step S570, the PF motor control section 111 determines whether a predetermined threshold time has elapsed from the driving timing (start of driving or end of driving) of the transport driving roller 51*a* in the paper transporting process (Step S410) that is performed in a synchronized manner. When the predetermined threshold time or more elapses, a short brake is applied in Step S560 so as to complete the roll control process. Accordingly, the roll body RP can be prevented from being driven at abnormal timings. For example, it can be prevented that the roll body RP is driven by a user touching the paper sheet P during the head driving process. As described above, in Steps S555, S565, and S570 of this embodiment, the stop condition of the roll control process (forward rotation control process) is determined each time the minute time Δt elapses. Then, when the stop condition is satisfied, the short brake is applied to the RR motor 33.

In Step S575, it is determined whether the transport speed V that is calculated in Step S545 exceeds the upper limit Vu of the transport speed. In addition, as shown in FIG. 20, the upper limit Vu of the transport speed is set to 110% of the maximum transport speed V in each speed mode VM1 to VM4. Accordingly, it can be determined whether the transport speed V of the paper sheet P that is transported by the roll body RP is higher than the estimated maximum transport speed V of the paper sheet P that is transported by the transport driving roller 51*a*. When the transport speed V of the paper sheet P that is transported by the roll body RP is higher than the maximum transport speed V, looseness may be generated in the paper sheet P between the transport driving roller 51*a* and the roll body RP. Accordingly, in order to brake the roll body RP, the output torque M to be outputted by the RR motor 33 is set to zero (Step S580). In other words, the Duty (hereinafter, denoted by the set Duty) of the PWM signal to be output to the RR motor 33 during the next time Δt is set to zero.

In Step S585, the current control state is determined to be one of the initial-period control state, the intermediary-period control state, and the latter-period control state, and the process is branched based on the results of the determination. In the initial state, the control state is set to the initial control state, and accordingly, the process proceeds to Step S605 corresponding to the initial-period control state. Hereinafter, the process in the initial-period control state will be described. In Step S605, the initial tension Ts is set as the designated tension F, and the output torque M and the Duty for applying the initial tension Ts to the paper sheet P are calculated. In particular, by substituting the transport speed V in the above-described Equation 3, the static load N of rolling at the transport speed V is calculated. Then, by substituting the static load N of the rolling and the initial tension Ts in the above-described Equation 5, the output torque M of the RR motor 33 is calculated.

Then, the Duty for acquiring the output torque M is calculated by using the above-described Equation 6, and the Duty is set as the set Duty of the PWM signal to be output to the RR motor 33 during a next minute time Δt. As shown in FIG. 20, the initial tension Ts has a large value for the slowest speed mode VM4 and has a small value for other speed modes VM1 to VM3. Based on the relationship shown in Equation 5, the output torque M having the large value is output in the speed modes VM1 to VM3 in which the initial tension Ts is small. In Step S610, it is determined whether the transport speed V that is calculated in Step S545 exceeds the control transferring transport speed Vs that is acquired from the parameter table PT. Then, when the transport speed V exceeds the control transferring transport speed Vs, the control state proceeds to the intermediary-period control state (Step S615). In Step S620, it is determined whether driving of the transport driving roller 51*a* is completed in the paper transporting process (Step S410) that is performed in a synchronized manner. Then, when the driving of the transport driving roller 51*a* is completed, the control state proceeds to the latter-period control state (Step S625). Accordingly, the process that is unique to the initial control state is completed.

In Step S630, it is determined whether the set Duty is between a predetermined lower limit and a predetermined upper limit. When the set Duty is smaller than the lower limit, the set Duty is changed to the lower limit (Step S635). Similarly, when the set Duty is larger than the upper limit, the set Duty is changed to the upper limit (Step S640). Accordingly, an abnormally large set Duty can be prevented, and thus overdrive of the RR motor 33 can be prevented. In Step S645, the RR motor control section 112 outputs the PWM signal of the set Duty to the RR motor 33, and the process returns to Step S540. In Step S540, the elapse of the minute time Δt is waited for again, and the process thereafter is performed based on the transport speed V during the minute time Δt, and the like.

Next, the process in the intermediary-period control state will be described. In Step S585, when the current control state is determined to be the intermediary-period control state, the output torque M and the Duty for achieving the designated tension F at the transport speed V, that is calculated in Step S545, are calculated in Step S650. In particular, by substituting the transport speed V calculated in Step S545 in the above-described Equation 3, the static load N of rolling is calculated. In addition, by substituting the static load N of rolling and the designated tension F in the above-described Equation 5, the output torque M of the RR motor 33 is calculated. Then, by substituting the output torque in the above-described Equation 6, the Duty can be calculated. The calculated Duty is set as the set Duty.

Accordingly, the process that is unique to the intermediary control state is completed, and the processes of Step S620 and thereafter are performed. In other words, when the set Duty is set, it is determined whether driving of the transport driving roller 51*a* is completed in the paper transporting process (Step S410) that is performed in a synchronized manner in Step S620. Then, when the driving of the transport driving roller 51*a* is completed, the control state proceeds to the latter-period control state (Step S625). Then, as needed, the set Duty is changed in Steps S635 and S640, and the PWM signal of the final set Duty is output to the RR motor 33 in Step S645.

Next, the process in the latter-period control state will be described. In Step S585, when the current control state is determined to be the latter-period control state, the output torque M and the Duty for achieving the designated tension F at the transport speed V, which is calculated in Step S545, are calculated in Step S655. In particular, by substituting the transport speed V, which is calculated in Step S545, in the above-described Equation 3, the static load N of rolling is calculated. In addition, the output torque M of the RR motor 33 is calculated by substituting the static load N of rolling and the designated tension F in the above-described Equation 5. By substituting the output torque in the following Equation 7, the Duty is calculated. Then, the calculated Duty is set as the set Duty.

$$\text{Duty} = k5 \times \frac{(100 - b)}{100} \times M \tag{7}$$

In the above-described Equation 7, the Duty that is acquired by decreasing the Duty, which is acquired in the above-described Equation 6 at the rate of the free-running braking ratio b, which is acquired from the parameter table PT by using the Duty acquired in the above-described Equation 6, is calculated. Accordingly, braking in accordance with the free-running braking ratio b can be performed. As described above, the process that is unique to the latter-period control state is completed, and the process of Step S630 and thereafter is performed. In other words, as needed, the set Duty is changed in Steps S635 and S640, and the final set Duty is outputted to the RR motor 33 in Step S645.

On the other hand, a process (hereinafter, referred to as a reverse rotation control process) for a case where the output torque M for achieving the designated tension F at the transport speed V=0 is determined to be negative in Step S530, that is, a case where the roll body RP is driven to rotate in the reverse direction so as to supplement the tension T up to the designated tension F will be described. The reverse rotation control process is also a looping process for updating the Duty that is outputted to the RR motor 33 by the RR motor control section 112 during the next time Δt each instance the time Δt synchronized with a predetermined clock signal elapses. In Step S660, the process is waited until the PF motor control section 111 drives the transport driving roller 51*a* by performing the paper transporting process (Step S410) that is performed in a synchronized manner. Then, the measurement of the time Δt is started in Step S665 simultaneously with starting to drive the transport driving roller 51*a*, and the process waits for the time Δt to elapse. In addition, the short brake of the RR motor 33 is also continued during this period. In the forward rotation control process, the time Δt is measured from a predetermined time before the instance when the transport driving roller 51*a* starts to drive, and the set Duty is output for each time Δt. However, in the reverse rotation control process, the process is waits until the driving of the transport driving roller 51*a* is started, and measurement of the time Δt is started simultaneously with the start of the driving, which is different from that in the forward rotation control process.

In Step S670, it is determined whether the PF motor control section 111 stops the driving of the transport driving roller 51*a* in the paper transporting process (Step S410) that is performed in a synchronized manner. Then, when the driving of the transport driving roller 51*a* is stopped, the reverse rotation control process (roll control process) is completed, and the short brake is applied to the RR motor 33 (Step S675). On the other hand, when the transport driving roller 51*a* continues to be driven, the transport speed V of the paper sheet P that is transported by the roll body RP during the minute time Δt, similarly to Step S545, is calculated in Step S680. In Step S685, the output torque M and the Duty for achieving the designated tension F at the transport speed V, which is calculated in Step S680, are calculated in the same sequence as that in Step S605. Then, the calculated Duty is set as the set Duty, and the PWM signal of the set Duty is outputted to the RR motor 33 (Step S690). When the above-described processes are completed, the process returns to Step S665, the time Δt elapses, and the same process is repeated. Next, the operation of the above-described roll control process will be described.

Figure 21A:
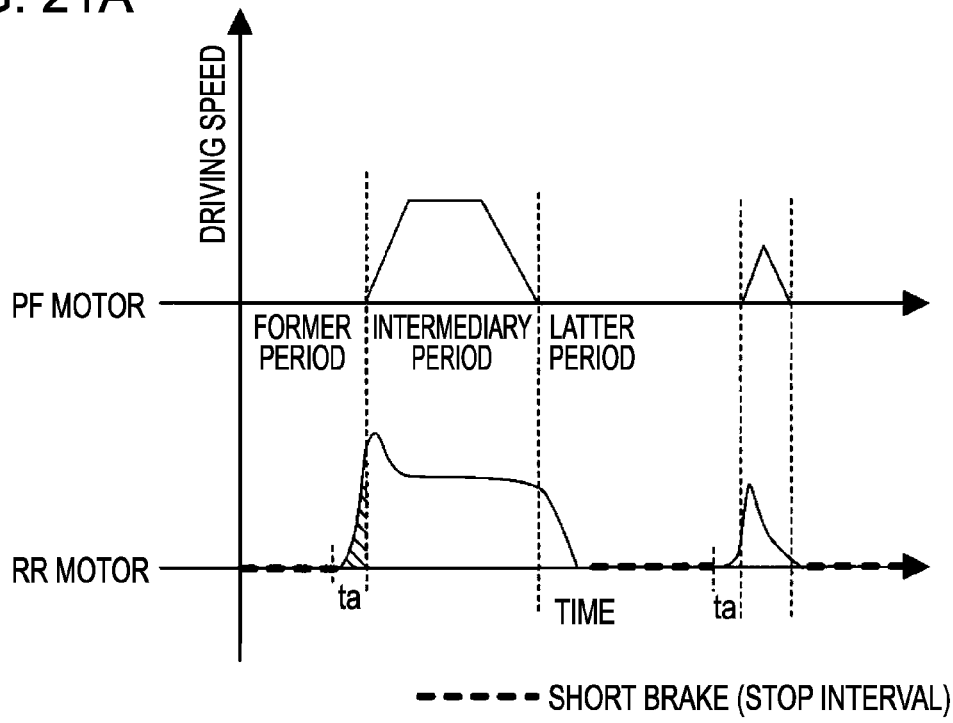
FIGS. 21A and 21B are timing charts showing the operations of a PF motor and an RR motor, according to an embodiment of the invention.
Figure 21B:
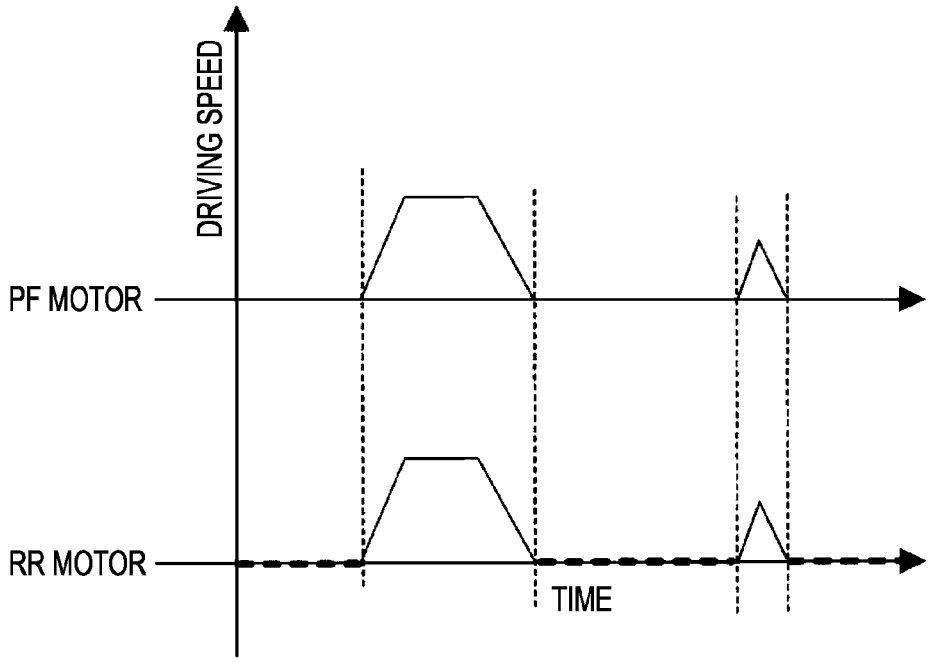

FIGS. 21A and 21B shows the trend of the driving speed of the RR motor 33 in the roll control process compared to the driving speed of the PF motor 53. FIG. 21A shows an example of the operation of the forward rotation control process, and FIG. 21B shows an example of the operation of the reverse rotation control process. First, in the initial control state of the forward rotation control process, the PWM signal of the set Duty for achieving the initial tension Ts is outputted to the RR motor 33 from a predetermined time ta before the instance when the PF motor 53 is driven. Accordingly, the RR motor 33 is driven in the forward rotation direction before the PF motor 53. As described above, by driving the RR motor 33 before the PF motor 53, backlash (looseness) that is generated in the gear wheel row 32 (driving member), and the like, when the RR motor 33 is stopped at the previous time is eliminated.

Accordingly, appropriate tension control can be implemented in a state in which the driving of the PF motor 53 is started.

For example, the amount of backlash (the transport amount needed for elimination) for the case of driving at each speed mode VM1 to VM3 is checked, and it is preferable that the initial tension Ts and the control transferring transport speed Vs are set such that the transport amount ΔLrr (corresponding to the hatched area in the figure) for eliminating the amount of backlash is achieved at the time when driving of the PF motor 53 is started. According to this embodiment, a large initial tension Ts is set for the slowest speed mode VM4, and a small initial tension Ts is set for other speed modes VM1 to VM3. Based on the relationship of the above-described Equation 5, in the speed modes VM1 to VM3 for which the initial tension Ts is small, a large output torque M (a second driving force, an initial driving force) is outputted for the first time. Accordingly, in the speed modes VM1 to VM3, the backlash can be eliminated in a speedy manner. In addition, forward rotation of the roll body RP is promoted due to the large output torque M, rapid acceleration can be responded to (driven) in the speed modes VM1 to VM3.

As the time elapses in the initial control state, there are cases where the roll body RP actively starts forward rotation depending on the magnitude of the output torque M of the RR motor 33. In addition, when the driving of the transport driving roller 51*a* is started in the initial control state (before the transport speed V reaches the control transferring transport speed Vs), a case where the roll body RP actively starts to rotate forwardly in the initial control state can be considered. At any rate, as the time elapses, the driving speed of the RR motor 33 for the forward rotation direction increases. Then, the transport speed V exceeds the control transferring transport speed Vs in a stage, and the control state proceeds to the intermediary-period control state. In the intermediary-period control state, since the output torque M (first driving force) for applying the designated tension F to the paper sheet P is outputted by the RR motor 33, the tension T applied to the paper sheet P can be set as the designated tension F, and accordingly, an abnormal slip can be prevented. In addition, transport of the paper sheet P with high accuracy can be realized. However, the output torque M of the RR motor 33 is not set based on the driving speed of the RR motor 33. Thus, there are cases where the transport speed V of the roll body RP exceeds the upper limit Vu of the maximum transport speed that can be considered in the speed modes VM1 to VM3.

According to this embodiment, in the intermediary-period control state and the latter-period control state, when the transport speed V exceeds 110% of the upper limit Vu of the transport speed corresponding to each speed mode VM1 to VM3, the set Duty is forcedly set to zero, and a braking process is performed temporarily. Accordingly, transport performed by the roll body RP becomes excessive, and thereby generation of looseness in the paper sheet P can be prevented. While the intermediary-period control state is continued for the time being, the driving of the PF motor 53 is stopped, and the control state proceeds to the latter-period control state. In this latter-period control state, since the paper sheet P is not pulled by driving the PF motor 53, it can be determined that the roll body RP freely runs due to the inertia. When the roll body RP continues to rotate forwardly in spite of the driving of the PF motor 53 stopping, looseness is generated in the paper sheet P. According to this embodiment, by calculating the set Duty by using the above-described Equation 7 in the latter-period control state, the free-running of the roll body RP is prevented. As a result, looseness of the paper sheet P is prevented.

By using the above-described Equation 7, the output torque M (third driving force) that decreases at the ratio of the free-running braking ratio b can be set. In other words, by lowering the output torque M for the forward rotation direction, compared to that in the intermediary-period control state, the braking force is generated, whereby free-running of the roll body RP is stopped in an early stage. This free-running braking ratio b may be set differently in accordance with the speed modes VM1 to VM4. Thus, according to this embodiment, the free-running braking ratio b is increased as the speed goes up. As the speed is increased, the braking distance becomes long. However, by increasing the free-running braking ratio b as the speed goes up, the braking distance in the speed modes VM1 and VM2 of high speeds can be suppressed. Accordingly, an excessive transport amount ΔLrr of the paper sheet P that is transported by rotating the RR motor 33 can be prevented, with respect to the transport amount ΔLpf of the paper sheet P that is transported by rotating the PF motor 53, and looseness of the paper sheet P can be prevented.

When the PF motor 53 is also stopped from driving, and the rotation of the RR motor 33 is braked, the RR motor 33 is gradually decelerated. Then, the transport speed V resulting from rotating the roll body RP becomes below the control completing transport speed Vf. At that state, the forward rotation control process is completed, and a short brake is applied to the RR motor 33. The short brake is configured to be maintained until the set Duty is output in the next roll control process. However, when the transport amount ΔLrr is large, or the like, in the initial-period control state or the intermediary-period control state, a case where the transport amount ΔLrr is not sufficiently suppressed by performing the braking process according to the free-running braking ratio b in the latter-period control state can be considered. Therefore, according to this embodiment, even when the transport amount ΔLrr from the start of the roll control process performed by the roll body RP is larger than a transport amount threshold value that is acquired by adding the transport amount, which is acquired by substituting the transport amount limiting value α in the above-described Equation 2, to the target transport amount ΔLt of the paper transporting process that is performed in a synchronized manner, the short brake is applied to the RR motor 33 at that time point so as to complete the forward rotation control process. Accordingly, even in a state before the start of the deceleration of the roll body RP, excessive transport amount ΔLrr is prevented by stopping the driving of the RR motor 33, and whereby looseness of the paper sheet P can be prevented.

On the other hand, in the reverse rotation control process, output of the output torque M for the reverse rotation direction is performed by the RR motor 33 together with starting the driving of the PF motor 53, and the output of the output torque M for the reverse direction is stopped by the RR motor 33 together with the stopping of the driving of the PF motor 53. During the reverse rotation control process, the output torque M for applying the designated tension F to the paper sheet P is outputted by the RR motor 33 constantly. In the reverse rotation control process, driving of the RR motor 33 is not performed before driving the PF motor 53, and accordingly, basically the driving of the roll body RP is performed in a driven manner. The reverse rotation control process is performed when the output torque M for achieving the designated tension F at the transport speed V=0 is determined to be negative. The reverse rotation control process is a process for applying the output torque M for driving the roll body RP in the reverse rotation direction for supplementing insufficient tension T. When the output torque M for driving the roll body RP in the reverse rotation direction is applied, looseness in the paper sheet P is not generated, unlike the forward rotation control process. In addition, since the paper sheet is originally in the low-tension state, it is scarcely needed to eliminate the backlash by driving the roll body RP before start of driving the PF motor 53 or assist in the driving of the PF motor 53 by the free-running of the roll body RP. Accordingly, the process can be simplified.

As described above, the output torque M, that is not zero, is output to the RR motor 33 by performing the roll control process only in the middle of, prior to, and right after driving of the PF motor 53. In other periods, a short brake is applied to the RR motor 33. The driving of the RR motor 33 is performed so as to optimize the amount of slip at the time of transport by adjusting the tension T of the paper sheet P. However, in a period in which the PF motor 53 is not driven and the paper sheet P is not transported, there is no case where a slip is generated basically, and it may be thought that the tension T of the paper sheet P may not need to be adjusted. Accordingly, by performing the roll control process only in the middle of, prior to, and right after the driving of the PF motor 53, unnecessary power consumption can be suppressed while appropriate tension T is adjusted. In addition, resources such as CPU 101 can be acquired when the roll control process is not performed.

2-6. Looseness Eliminating Process

Figure 22:
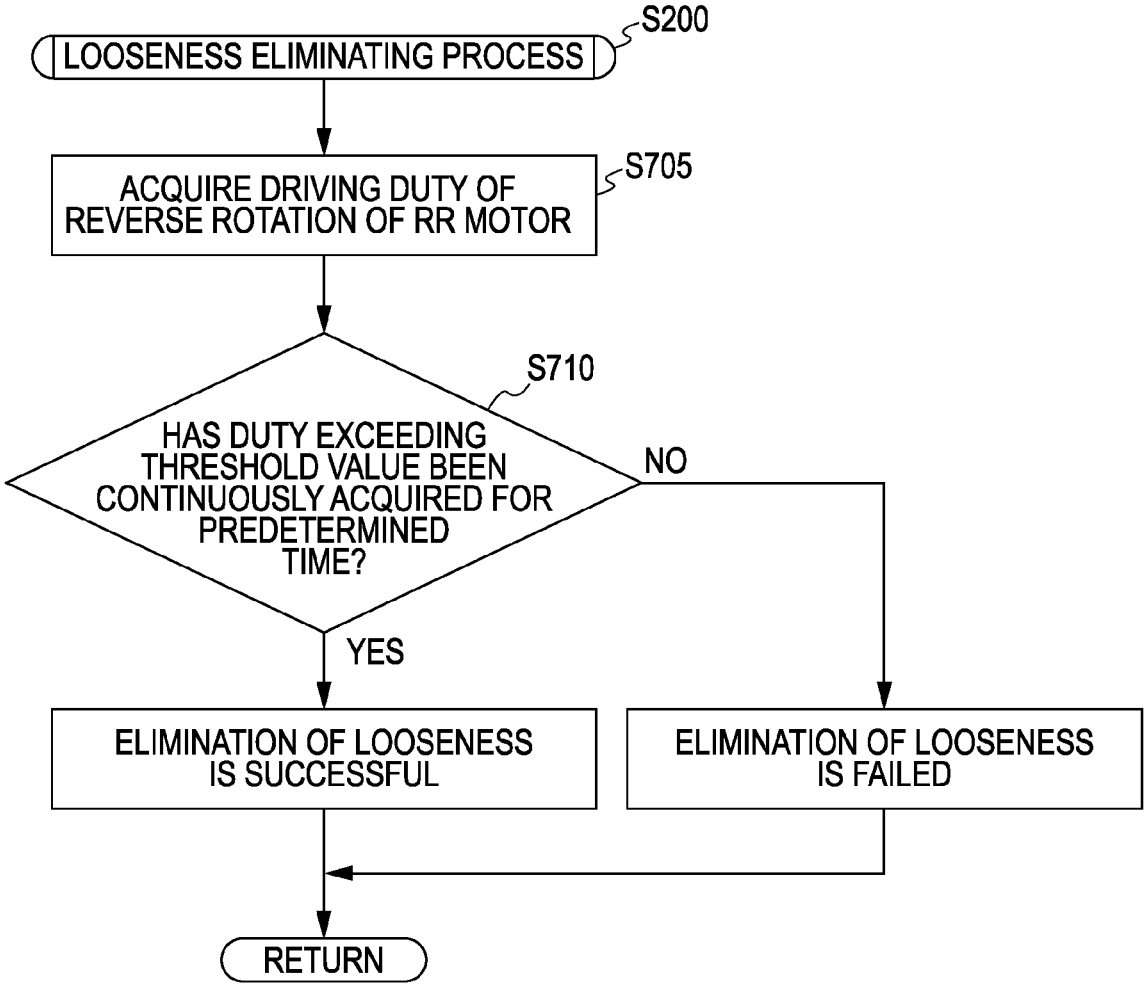
FIG. 22 is a flowchart showing a looseness eliminating process, according to an embodiment of the invention.

FIG. 22 shows the flow of the looseness eliminating process (Step S700). In Step S705, the RR motor control section 112 drives the RR motor 33 in the reverse rotation direction by performing the PID control for a predetermined time so as to start to wind the paper sheet P at a predetermined transport speed V. In Step S710, the control unit 100 acquires the Duty (the integral component of the PID control value) of the PWM signal that is outputted to the RR motor 33 by the RR motor control section 112 for each predetermined time period. When the amount (period×number of times), in which the Duty continuously exceeds a predetermined threshold value, exceeds a predetermined threshold time, the control unit 100 determines that the looseness is eliminated. On the other hand, even in a case where the RR motor 33 is driven for the predetermined time, when the time in which the Duty continuously exceeds the predetermined threshold value does not exceed the threshold time, the control unit 100 determines that elimination of the looseness is failed. For example, in a case where the winding direction of the roll body RP is installed oppositely or a separate paper sheet is set mistakenly, or when the RR motor 33 is driven in the reverse rotation direction, the looseness is increased. Accordingly, in such a case, the Duty does not exceed the predetermined threshold value, and it can be determined that the elimination of looseness is failed. The looseness eliminating process is performed before the above-described printing process or the measurement process, and it is preferable that the printing process or the measurement process is performed only for a case where elimination of the looseness is successful. In addition, when the Duty is abnormally large, for example, it may be determined that the paper sheet P passes obliquely.

In addition, the printer 10 according to the above-described embodiment may be a part of a multi-function apparatus such as a scanner apparatus or a copy apparatus. In the above-described embodiments, the ink jet printer 10 has been described. However, it is not limited to the printer 10, but merely the fact that it can eject fluids. For example, an embodiment of the invention may be applied to various types of printers such as a gel jet printer, a toner-type printer, and a dot impact printer.

What is claimed is:

1. A printing method, comprising:

driving a first motor for rotating a roll body around which a printing medium is wound;

intermittently driving a second motor for driving a transport driving roller that transports the printing medium;

intermittently ejecting ink using a print head onto the printing medium alternately with the driving of the second motor; and stopping the first motor from driving for at least a part of the period in which the driving of the second motor is stopped, wherein tension applied to the printing medium is constant during at least a part of a period in which the second motor is driven, wherein the tension is designated according to a type of the printing medium, wherein the driving of the first motor is started simultaneously with start of the driving of the second motor, when the tension is, increased by driving the first motor for applying the designated tension to the printing medium.

2. The printing method according to claim 1, wherein the tension is decreased when the driving of the first motor is started from a predetermined time before driving of the second motor is started.

3. The printing method according to claim 2, wherein a second driving force, which is larger than a first driving force, is outputted by the first motor when the driving of the first motor is started from the predetermined time before the driving of the second motor is started.

4. The printing method according to claim 3, wherein a looseness that is generated in a driving member that connects the first motor and the roll body together is eliminated when the second driving force from the first motor is outputted.

5. The printing method according to claim 3, wherein, when a driving speed of the first motor reaches a predetermined transfer speed after the driving of the first motor is started, the driving force outputted to the first motor is switched from the second driving force to the first driving force.

6. The printing method according to claim 3, wherein the driving force outputted to the first motor is switched to a third driving force, which is determined by decreasing the first driving force at a predetermined braking ratio, after the driving of the second motor is stopped.

7. The printing method according to claim 3, wherein the second motor drives the transport driving roller in a plurality of speed modes, and one or more of the second driving force, a transfer speed, an upper speed limit, an upper limit of the transport amount, a braking ratio, and a completion speed are set in accordance with the speed modes.

8. The printing method according to claim 2, wherein the driving force outputted to the first motor is set to zero when the driving speed of the first motor exceeds a predetermined upper limit of the speed.

9. The printing method according to claim 2, wherein the driving of the first motor is stopped when a transport amount of the printing medium that is sent out by the roll body exceeds a predetermined upper limit.

10. The printing method according to claim 2, wherein the driving of the first motor is stopped when the driving speed of the first motor is lower than a predetermined completion speed except for a time right after the driving of the first motor is started.

11. The printing method according to claim 1, wherein the driving of the first motor is stopped simultaneously with the stopping of the driving of the second motor.

12. The printing method according to claim 1, wherein a brake is applied to the first motor during a period in which driving of the first motor is stopped.

13. A printing apparatus, comprising:

a first motor that applies a driving force for rotating a roll body around which a printing medium is wound;

a second motor that applies a driving force for intermittently driving a transport driving roller that transports the printing medium;

a print head that intermittently ejects ink onto the printing medium alternately with the driving of the second motor; and a control unit configured to drive the first motor such that tension applied to the printing medium is constant during at least a part of the period in which the second motor is driven and stops the driving of the first motor during at least a part of the period in which the driving of the second motor is stopped, wherein the tension is designated according to a type of the printing medium, wherein the driving of the first motor is started simultaneously with start of the driving of the second motor, when the tension is increased by driving the first motor for applying the designated tension to the printing medium.

14. The printing apparatus according to claim 13, wherein the tension is designated by the control unit to decrease when the driving of the first motor is started from a predetermined time before driving of the second motor is started.

15. The printing apparatus according to claim 13, wherein the controller is configured to eliminate looseness that is generated in a driving member that connects the first motor and the roll body together by setting the driving force to a certain level when the first motor is started from a predetermined time before the driving of the second motor is started.

16. The printing apparatus according to claim 13, wherein controller is further configured to drive the second motor in a plurality of speed modes, and one or more of the second driving force, a transfer speed, an upper speed limit, an upper limit of the transport amount, a braking ratio, and a completion speed are set in accordance with the speed modes.

* * * * *